US005966115A

United States Patent [19]

Aoki

[11] Patent Number: 5,966,115

[45] Date of Patent: Oct. 12, 1999

[54] DRIVE UNIT AND ELECTRONIC EQUIPMENT

[75] Inventor: Shigeki Aoki, Suwa, Japan

[73] Assignee: Seiko Epson Corporation, Tokyo, Japan

[21] Appl. No.: 08/742,401

[22] Filed: Nov. 4, 1996

[30] Foreign Application Priority Data

Nov. 6, 1995 [JP] Japan ..... 7-287702
Nov. 1, 1996 [JP] Japan ..... 8-307344

[51] Int. Cl.[6] ..... G09G 1/16

[52] U.S. Cl. ..... 345/126; 345/100; 345/121

[58] Field of Search ..... 345/121, 126, 345/100

[56] References Cited

U.S. PATENT DOCUMENTS

| | | | |
|---|---|---|---|
| 4,326,201 | 4/1982 | Enokizono | 345/1 |
| 4,570,158 | 2/1986 | Bleich et al. | 345/126 |
| 4,689,824 | 8/1987 | Mitchell et al. | 345/126 |
| 4,806,920 | 2/1989 | Sawada | 345/126 |
| 4,823,080 | 4/1989 | Lin | 345/126 |
| 5,063,526 | 11/1991 | Kagawa et al. | 345/126 |
| 5,124,692 | 6/1992 | Sasson | 345/126 |
| 5,522,027 | 5/1996 | Matsumoto et al. | 345/503 |

FOREIGN PATENT DOCUMENTS

| | | |
|---|---|---|
| 57-88492 | 6/1982 | Japan . |
| 59-20196 | 5/1984 | Japan . |
| 59-210497 | 11/1984 | Japan . |
| 60-20764 | 5/1985 | Japan . |
| 7-152339 | 6/1995 | Japan . |

*Primary Examiner*—Mark R. Powell
*Assistant Examiner*—Vincent E. Kovalick
*Attorney, Agent, or Firm*—Oliff & Berridge, PLC

[57] ABSTRACT

There are provided a drive unit which can be adjusted to various mounting forms and which can be reduced in power consumption and scale, and an electronic equipment containing such a drive unit. When a control signal DIR is switched from L-level to H-level, a logical operation circuit comprising a plurality of logic gates changes a READ address A which is in turn outputted toward a display memory. More particularly, an inverted signal of the READ address A is outputted as a READ address B. Thus, an image displayed on a liquid crystal display panel is vertically inverted. The drive unit can be adjusted to various mounting forms for the liquid crystal display device. Where the display memory includes a code data memory and a CG-ROM, first and second logical operation circuits are provided for each of the code data memory and CG-ROM. The output of the CG-ROM is connected to a third logical operation circuit which performs the lateral inversion for each character. The vertical and lateral inversion can also be accomplished by providing a decoder which outputs a latch signal at different timing at each time when the control signal DIR is switched from one level to another.

12 Claims, 27 Drawing Sheets

NOMAL MODE (FIRST DISPLAY MODE)

VERTICAL INVERSION (SECOND DISPLAY MODE)

LATERAL INVERSION (THIRD DISPLAY MODE)

VERTICAL AND LATERAL
(180 DEGREES) INVERSION
(FOURTH DISPLAY MODE)

| LINE ADDRESS | |
|---|---|
| 0 | CHARACTER CODE DATA (12 CHARACTERS) |
| 1 | CHARACTER CODE DATA (12 CHARACTERS) |
| 2 | CHARACTER CODE DATA (12 CHARACTERS) |
| 3 | DOT IMAGE DATA |
| 4 | DOT IMAGE DATA |

| QMD \ DIR | L | H |
|---|---|---|
| QMD0 | MD0 | MD4 |
| QMD1 | MD1 | MD3 |
| QMD2 | MD2 | MD2 |
| QMD3 | MD3 | MD1 |
| QMD4 | MD4 | MD0 |

DRIVE UNIT AND ELECTRONIC EQUIPMENT

BACKGROUND OF THE INVENTION

1. Field of the Invention

This invention concerns a drive unit and an electronic equipment which contains such a drive unit.

2. Description of the Related Art

Recently, the liquid crystal display is used for various electronic equipment such as a portable telephone, a personal haydyphone system (PHS), a cellular phone, a pager, a printer, an electronic notebook, a television and a personal computer as a small display device of low power consumption. It is desired for the liquid crystal display to be further reduced in power consumption and size. Therefore, it is also demanded for a liquid crystal drive unit included in this liquid crystal display device to be reduced in power consumption and scale.

In general, a lot of wiring connects the liquid crystal drive unit with a liquid crystal display panel. Therefore, there is raised a problem in that the above-mentioned wiring may become very complex depending on a direction of the drive unit relative to the display screen of the display panel. A technique which solves such a problem is disclosed in Japanese Patent Application Laid-Open No. Hei 7-152339, for example. In this disclosure, an address generating procedure for an access to a display RAM which stores code data is stored in a nonvolatile display control ROM. However, this technique needs a display control ROM having the same memory capacity as the display RAM. Since an area necessary for this display control ROM is very large, the liquid crystal drive unit will be increased in scale. Moreover, it is necessary to arrange all transistors composing the display control ROM in one unit on a semiconductor chip. Therefore, this technique using the display control ROM has a limited freedom of layout.

SUMMARY OF THE INVENTION

The present invention is invented in view of the above-mentioned problems. An object of the present invention is to provide a small-scale drive unit and electronic equipment which can be adjusted to various mounting forms and which can be reduced in power consumption.

To solve the above-mentioned problem, the present invention provides a drive unit comprising:

scan line drive means for supplying signals to a plurality of scan lines on a display panel;

address generating means for generating a first address;

logical operation means including a plurality of logic gates, wherein the logical operation means receives a given control signal to convert the first address into a second address for a second display mode and then to output the second address when the control signal directs the logical operation means to change a mode of display from a first display mode to the second display mode;

display data storage means for storing display data and for reading and outputting stored display data based on an output from the logical operation means; and signal line drive means for supplying signals to a plurality of signal lines on the display panel based on the display data from the display data storage means.

The first address generated by the address generation means is converted into the second address for the second display mode when the control signal directs the logical operation means to change a mode of display from the first display mode to the second display mode. Thus, for example, the display device including the drive unit will display a vertically-inverted image on the display panel by the above-described conversion of address when the second display mode is one that performs a vertical inversion. As a result, the drive unit can be easily adjusted to various forms in which it is mounted on the electronic equipment having various limits of the shape and others. Furthermore, the switching from the first display mode to the second display mode can be made simply by changing the directions by the control signal. Therefore, the number of drive unit types, maintenance cost and manufacturing cost can be reduced, in comparison with other cases in which the first display mode would be switched to the second display mode through change of a glass mask or the like. In addition, the logical operation means for converting the first address into the second address is composed of a plurality of logic gates. Thus, the drive unit can greatly be reduced in scale, in comparison with a drive unit in which the display control ROM is used. The degree of freedom can also be increased. Moreover, the variety of display in the display unit including the drive unit of the present invention can be improved.

The control signal may be of two or more bits rather than one bit. In the first display mode, instead of the first address itself, an address obtained by subjecting the first address to any of various processing techniques may be used.

It is preferred that the display data storage means automatically performs one of an increment operation and a decrement operation for a write address at each time when an external control means writes the display data after setting of an initial address;

wherein the address generating means performs the same operation that is performed for the write address by the display data storage means for the first address; and wherein the logical operation means performs another operation reverse to the operation performed for the write address by the display data storage means for the second address when the control signal directs the logical operation means to change the mode of display from the first mode to the second mode.

Thus, the same operation that is performed for the write address in the display data storage means can be done for the read address. This can simplify the processing. Since the logical operation means can be adjusted to the switching to the second display mode simply by changing the type of the operation for the address, it can be simplified in construction. Since the external control means such as CPU can write the display data into the display data storage means without setting of the address after the initial address has been set, the burden on the external control means can be reduced.

It is also preferred that the display data storage means includes code data storage means for storing code data, and pattern data storage means for storing pattern data specified by the code data;

wherein the logical operation means includes:

first logical operation means having a plurality of logic gates, wherein the first logical operation means receives the control signal to convert the first address into the second address for the second display mode and then to output the second address to the code data storage means when the control signal directs the first logical operation means to change the mode of display from the first display mode to the second display mode; and second logical operation means having a plurality of logic gates, wherein the second logical operation means receives the control signal to convert the first address into the second address for the second display mode and then to output the second address to the pattern data storage means when the control signal directs the second logical operation means to change the mode of display from the first display mode to the second display mode.

In such an arrangement, the switching to the second display mode can easily be performed if an image is to be displayed on the display panel using the code data such as character code data. This enables the system to be adjusted to various mounting forms.

It is preferred that the first logical operation means performs the conversion of a line address in the first address and the second logical operation means converts a raster address (or a line address of the dots forming the pattern data) in the first address. The display data storage means may include means for storing dot image data.

The present invention also provides a drive unit comprising:

scan line drive means for supplying signals to a plurality of scan lines on a display panel;

address generating means for generating a first address;

code data storage means for storing code data;

pattern data storage means for storing first pattern data specified by the code data;

third logical operation means having a plurality of logic gates, wherein the third logical operation means receives a given control signal to convert the first pattern data into third pattern data for a third display mode and then to output the third pattern data when the control signal directs the third logical operation means to change a mode of display from a first display mode to the third display mode;

a plurality of decoder means for receiving the control signal to generate third fetching signals for the third display mode based on the first address when the control signal directs the decoder means to change the mode of display from the first display mode to the third display mode;

a plurality of temporary storage means each of which is provided for each of the decoder means for temporarily storing the third pattern data based on one of the third fetching signals; and signal line drive means for supplying signals to a plurality of signal lines on the display panel based on an output from the temporary storage means.

When the control signal directs the third logical operation means to change a mode of display to the third display mode, the third logical operation means converts the first pattern data into the third pattern data for the third display mode and the decoder means generates the third fetching signals for the third display mode. The third pattern data outputted from the third logical operation means is stored in the temporary storage means according to the third fetching signals and then transferred from the temporary storage means to the signal line drive means. In other words, the third logical operation means performs an inversion for each pattern data and the decoder and temporary storage means make a change of arrangement of the pattern data. Thus, the mode of display can be changed to the third display mode. For example, the image displayed on the display panel can be laterally inverted. This enables the drive unit to be adjusted to various mounting forms. Furthermore, the variety of display in the display device including the drive unit can be increased. In addition, a simplified control can be provided by using the common control signal to control the conversion in the third logical operation means and the generation of the third fetching signals in the decoder means.

The present invention also provides a drive unit comprising:

scan line drive means for supplying signals to a plurality of scan lines on a display panel;

address generating means for generating a first address;

code data storage means for storing code data;

pattern data storage means for storing first pattern data specified by the code data;

first logical operation means having a plurality of logic gates, wherein the first logical operation means receives a given control signal to convert the first address into a fourth address for a fourth display mode and then to output the fourth address to the code data storage means when the control signal directs the first logical operation means to change a mode of display from a first display mode to the fourth display mode;

second logical operation means having a plurality of logic gates, wherein the second logical operation means receives the control signal to convert the first address into the fourth address for the fourth display mode and then to output the fourth address to the pattern data storage means when the control signal directs the second logical operation means to change the mode of display from the first display mode to the fourth display mode;

third logical operation means having a plurality of logic gates, wherein the third logical operation means receives the control signal to convert the first pattern data into a fourth pattern data for the fourth display mode and then to output the fourth pattern data when the control signal directs the third logical operation means to change the mode of display from the first display mode to the fourth display mode;

a plurality of decoder means for receiving the control signal to generate fourth fetching signals for the fourth display mode based on the first address when the control signal directs the decoder means to change the mode of display from the first display mode to the fourth display mode;

a plurality of temporary storage means each of which is provided for each of the decoder means for temporarily storing the fourth pattern data based on one of the fourth fetching signals; and signal line drive means for supplying signals to a plurality of signal lines on the display panel based on an output from the temporary storage means.

The third logical operation means, decoder means and temporary storage means can perform the lateral inversion while the first and second logical operation means can make the vertical inversion, for example. Thus, it becomes possible to perform the switching to the fourth display mode, that is, the vertical and lateral inversion of an image displayed on the display panel, for example. As a result, the drive unit can be adjusted to various mounting forms with the variety of display.

It is preferred that the code data storage means automatically performs one of an increment operation and a decrement operation for a write address at each time when an external control means writes the code data after setting of an initial address;

wherein the address generating means performs the same operation that is performed for the write address by the code data storage means for the first address; and wherein the second logical operation means performs another operation reverse to the operation performed for the write address by the code data storage means for the fourth address when the control signal directs the second logical operation means to change the mode of display from the first mode to the fourth mode.

This can simplify the processing and the structure of the first and second logical operation means and also reduce the burden on the external control means.

It is also preferred that the control signal is generated based on one of a signal from an external terminal and contents of a built-in register, wherein the signal and contents can be changed to be adjusted to a mounting form of the display panel.

Thus, the directions from the control signal can be changed by controlling the external terminal signal through the external control means, fixing the external terminal signal at a given level or rewriting the contents of the built-in register through the external control signal. This enables the drive unit to be adjusted to various mounting forms in an easy manner.

The present invention also provides an electronic equipment including any one of the above-described drive units.

Thus, the drive unit or the display device including the drive unit can be mounted on any of various electronic equipment such as a portable telephone, PHS, a cellular phone, a pager, a printer, audio equipment, potable information processing equipment, a television, a personal computer and a projector in any one of various mounting forms. Consequently, the electronic equipment can be reduced in size and cost. The variety of display can be also provided to the display device included in the electronic equipment.

DETAILED DESCRIPTION OF THE PREFERRED EMBODIMENTS

Some preferred embodiments of the present invention will now be described with reference to the drawings.

(First Embodiment)

Figure 1:
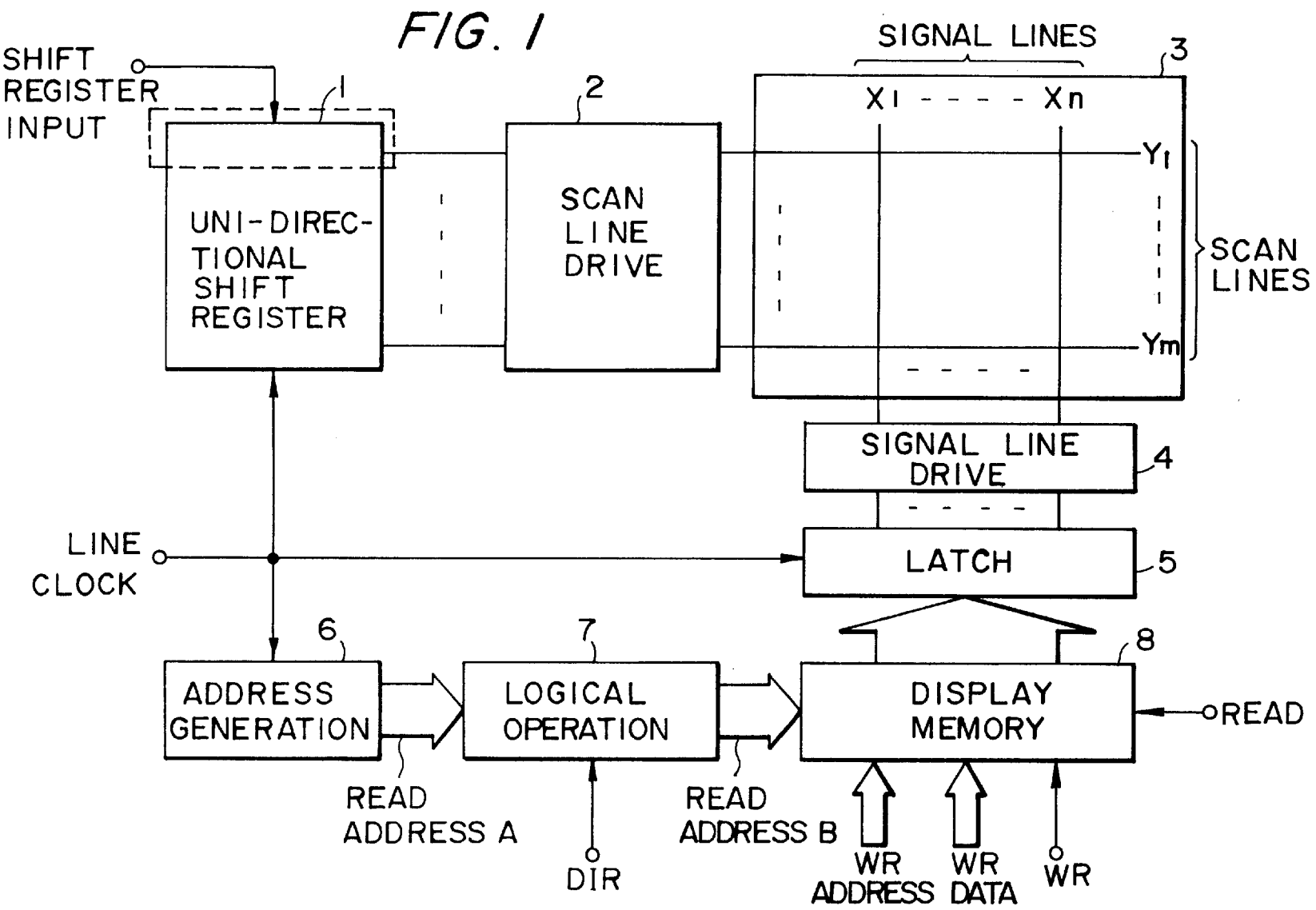
FIG. 1 is a block diagram of the first embodiment of the present invention.

FIG. 1 shows a liquid crystal drive unit according to the first embodiment of the present invention. The liquid crystal drive unit comprises a uni-directional shift register 1, a scan line drive circuit 2, a signal line drive circuit 4, a latch section 5, an address generating circuit 6, a logical operation circuit 7 and a display memory 8. The scan line drive circuit 2 supplies signals to a plurality of scan lines Y1–Ym in a liquid crystal display panel 3. More particularly, the scan line drive circuit 2 outputs a signal of a selection level to each of the scan lines Y1, Y2 . . . Ym in the described order. On this line scanning, the uni-directional shift register 1 outputs a signal for selecting one of the scan lines to the scan line drive circuit 2. The signal line drive circuit 4 supplies signals to a plurality of signal lines X1–Xn in the liquid crystal display panel 3, based on the display data temporarily stored in the latch section 5. The display memory 8 includes bits each of which is defined to correspond to one of the bits in the dot-matrix type liquid crystal display panel 3, and is connected to a data bus, an address bus, and a control line for writing, and a data bus, an address bus, and a control line for reading. The address generating circuit 6 generates a READ address A (first address) which is in turn outputted toward the logical operation circuit 7. The logical operation circuit 7 is one of the primary parts in this embodiment. When a control signal DIR of a given level is inputted, the logical operation circuit 7 converts the READ address A into a READ address B (second address) which is in turn outputted toward the display memory 8. The logical operation circuit 7 is formed by a plurality of logic gates.

Figure 2:
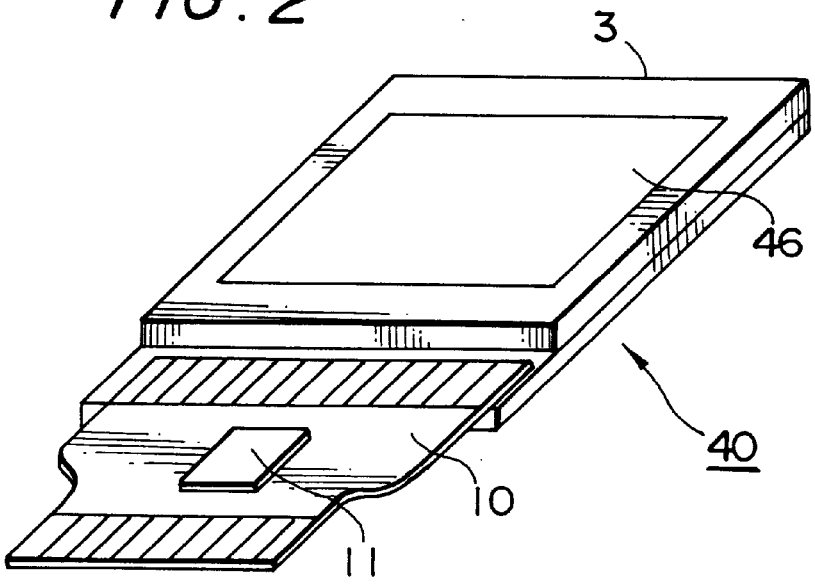
FIG. 2 is a perspective view showing an example of a liquid crystal display device (liquid crystal module).
Figure 3:
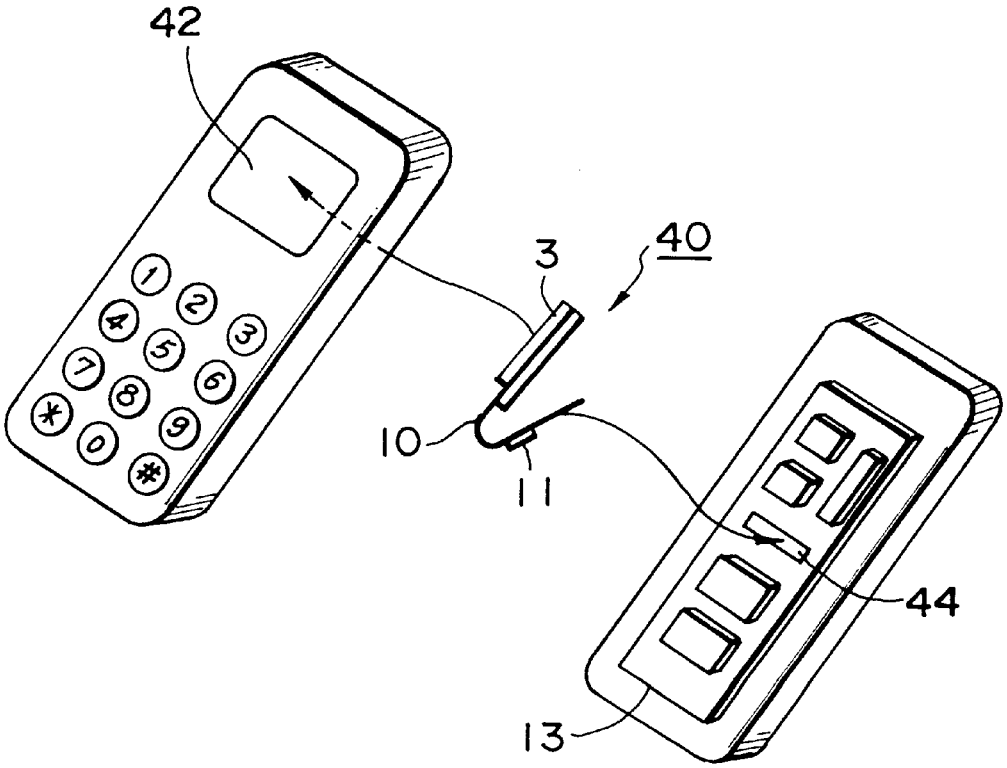
FIG. 3 is a view illustrating the mounting of the liquid crystal display device on the electronic equipment.
Figure 4A:
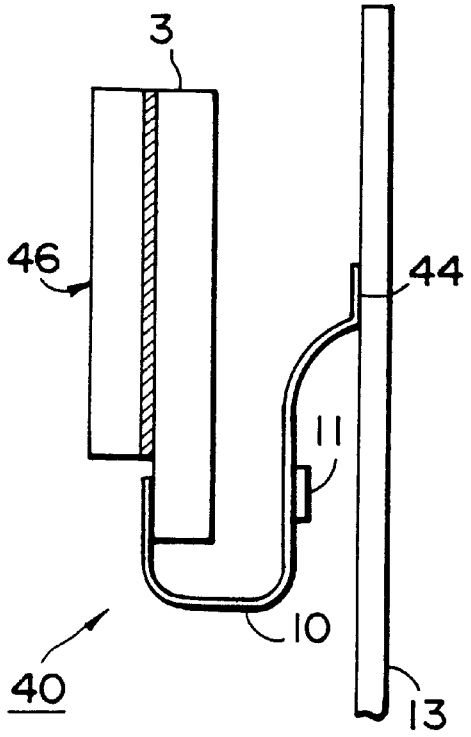
FIG. 4 is a view showing a mounting form of the liquid crystal display device.
Figure 4B:
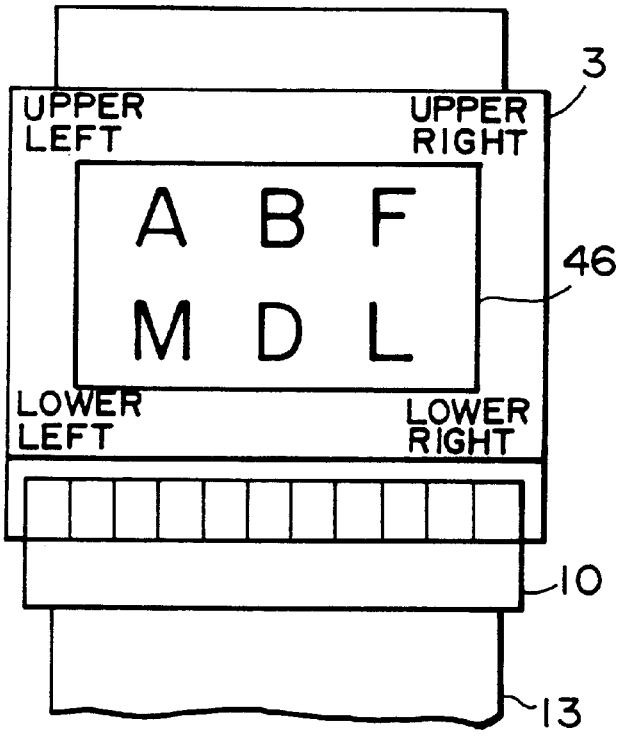

FIG. 2 shows a liquid crystal display device (liquid crystal module) 40 which contains the liquid crystal drive unit according to this embodiment. The liquid crystal display panel 3 comprises two glass boards and a liquid crystal layer enclosed between these glass boards. On the liquid crystal display panel 3 are formed scan and signal lines which are formed of transparent and conductive film. The liquid crystal display panel 3 is connected to a polyimide tape 10 on which conductive metal films are printed. On the polyimide tape 10 is mounted an IC chip 11 which corresponds to the liquid crystal drive unit according to this embodiment. A mounting form as shown in FIG. 2 is generally called Tape Carrier Package (TCP). The liquid crystal display device 40 can be mounted into an electronic equipment, for example, into a portable telephone as shown in FIG. 3. The liquid crystal display panel 3 connected to the polyimide tape 10 at one end is mounted into a display portion 42 in the portable telephone. The other end of the polyimide tape 10 is soldered to a connection area 44 on a printed board 13 of the telephone. The printed board 13 includes control and wireless communication IC chips and associated wiring formed thereon. FIG. 4 shows side and front views of the liquid crystal display device 40 mounted into the portable telephone. In such a case, the display screen 46 displays an image in a normal mode (the first display mode).

Figure 5A:
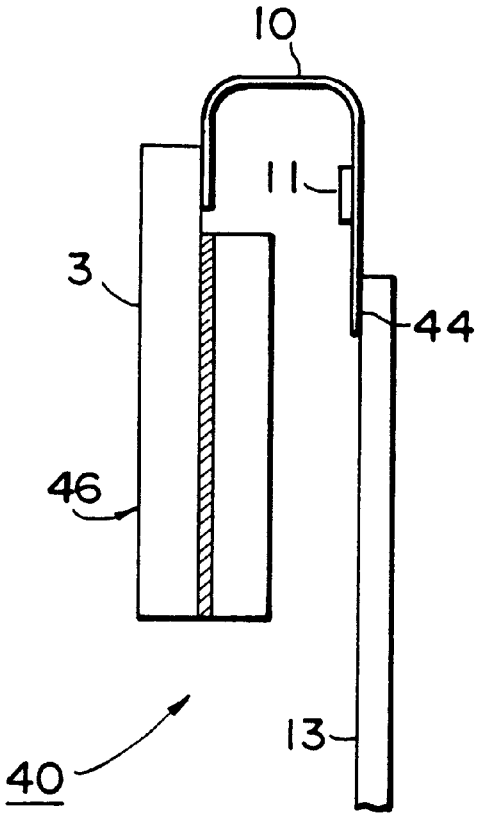
FIG. 5 is a view showing another mounting form of the liquid crystal display device.
Figure 5B:
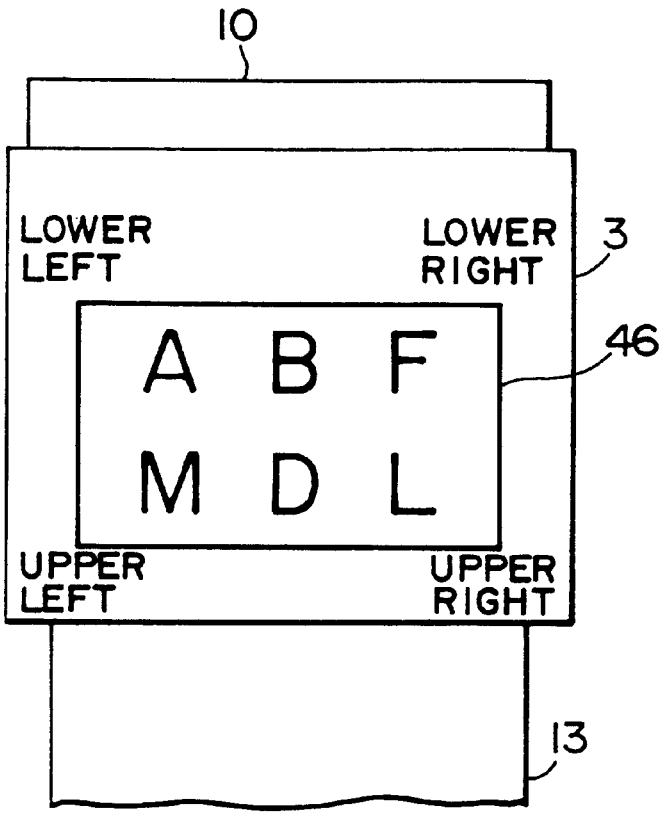
Figure 6A:
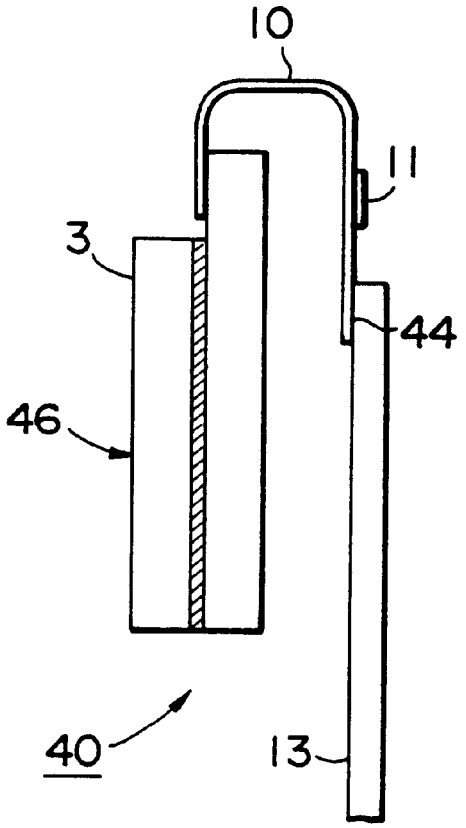
FIG. 6 is a view showing still another mounting form of the liquid crystal display device.
Figure 6B:
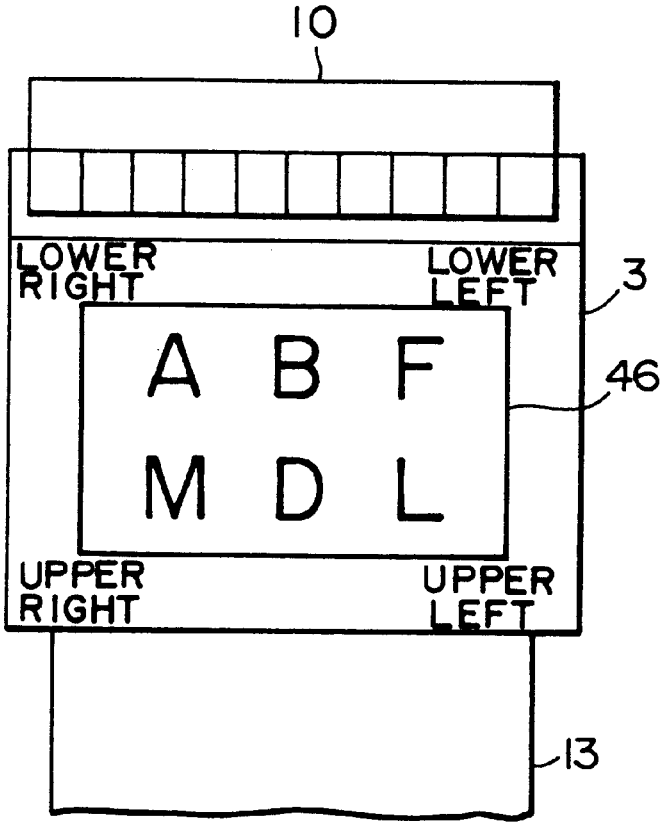

However, the connection area 44 must be formed on the printed board 13 at the center position thereof in such a mounting form as shown in FIGS. 3 and 4. The connection area 44 at the center position complicates the wiring between the IC chips on the printed board 13. FIGS. 5 and 6 show mounting forms which can be used to solve this problem. In the mounting form shown in FIGS. 5 and 6, the connection area 44 is formed on the edge of the printed board 13. Thus, the wiring and connection between the IC chips on the printed board 13 can easily be accomplished. However, when the liquid crystal display device is mounted as shown in FIG. 5, an image to be displayed on the display screen 46 has to be vertically inverted as shown in FIG. 7B (the second display mode). In FIG. 4, the display screen 46 is formed on the upper glass board. In FIG. 5, however, the display screen 46 is formed on the glass board which is at a lower position in FIG. 4. Therefore, if the liquid crystal display device 40 is of reflective type, the structure of FIG. 5 must have a reflecting plate located at a different position from that of FIG. 4. On the other hand, a structure in FIG. 6 is not required to locate a reflecting plate at a different position from that of FIG. 4, but an image displayed on the display screen 46 has to be inverted laterally and vertically, as shown in FIG. 7D (the fourth display mode). The lateral and vertical inversion can be done by combining the vertical inversion (the second display mode) shown in FIG. 7B with the lateral inversion (the third display mode) shown in FIG. 7C.

In this way, the liquid crystal display device 40 needs to be mounted in different forms since there are various limitations on space depending on the structure of the electronic equipment. Thus, images of different display modes as shown in FIGS. 7A–7D corresponding to the different mounting forms as shown in FIGS. 4–6 has to be displayed. In order that, the present invention provides the logical operation circuit as shown in FIG. 1 to be used with the control signal DIR to convert READ address into various addresses.

The operation of this embodiment will now be described. First of all, WR data or display data is written into the display memory 8 from an external control means such as CPU or a microcomputer at a location specified by a WR address. At this time, a mode setting signal WR is set at a low (L) level to bring the display memory 8 into a write mode.

Figure 8:
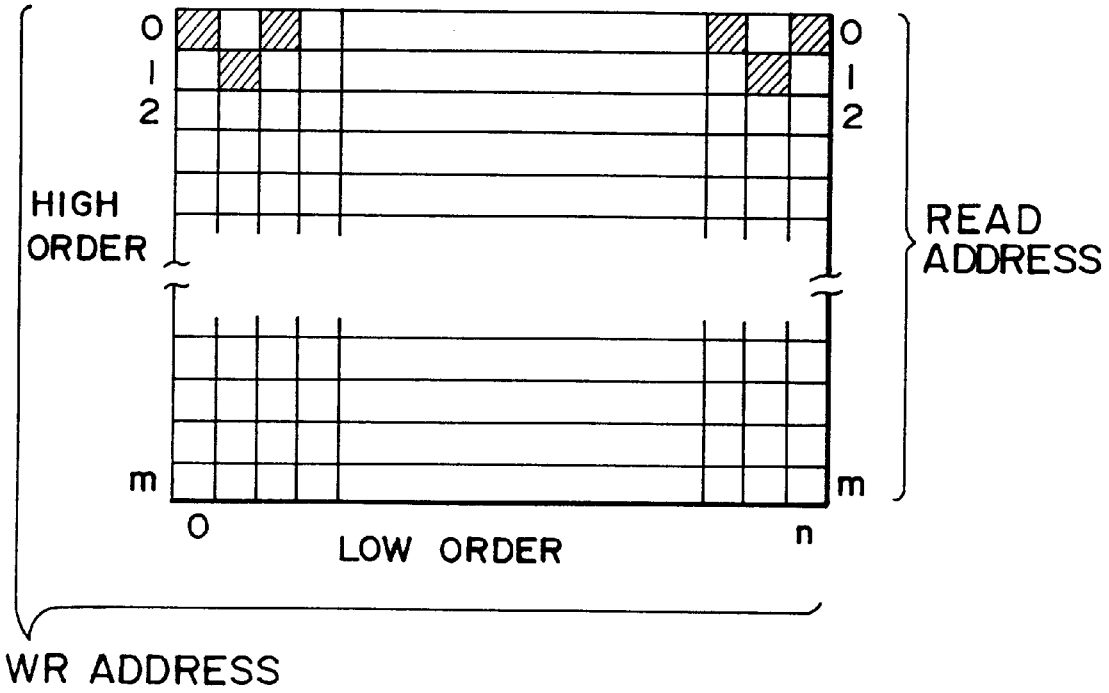
FIG. 8 illustrates a memory map in a display memory.

FIG. 8 shows a structure of the display memory 8. Each of the bits in the display memory 8 corresponds to one dot in the liquid crystal display panel 3. In other words, the vertical addresses as viewed in FIG. 8 correspond to scan lines while the horizontal addresses correspond to signal lines.

The uni-directional shift register 1 performs a shifting in response to a line clock (line scanning clock). The scan line drive circuit 2 outputs a signal of a selection or non-selection level to the scan lines in response to the output of the uni-directional shift register 1. The display data corresponding to the selected scan line is then read out from the display memory 8. The read display data is hold by the latch section 5 and also outputted toward the signal line drive circuit 4. At this time, the address generating circuit 6 outputs the READ address A toward the logical operation circuit 7 wherein the READ address A is converted into the READ address B. Display data specified by this READ address B is read out from the display memory 8. At this time, a mode setting signal READ is set at L-level, for example, to place the display memory 8 in the read mode. By a series of such operations, signals are fed to the scan and signal lines in the liquid crystal display panel 3 wherein the line scanning will be made.

Figure 9:
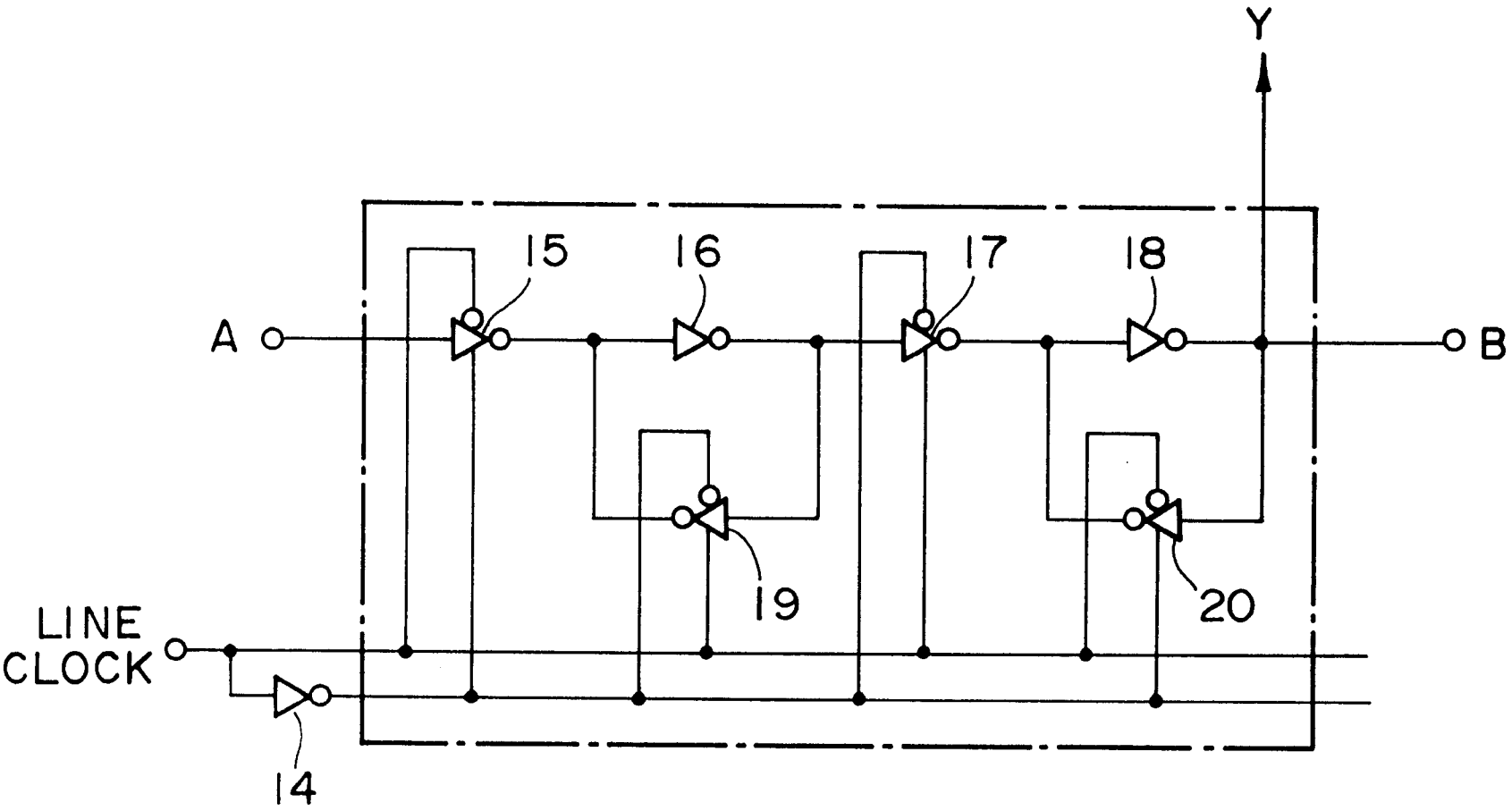
FIG. 9 is a circuit diagram of a uni-directional shift register.

FIG. 9 shows the details of a circuit for one bit in the uni-directional shift register 1 (corresponding to a portion within a broken-line block in the uni-directional shift register 1 in FIG. 1). The circuit of FIG. 9 is formed by clock gates 15–20. In this circuit, a level at a terminal A is transferred to another terminal B at the leading edge of the line clock. The data is held during a period when the line clock is placed at high (H) level or L-level.

In order to adjust to various mounting forms, the liquid crystal drive unit of FIG. 1 changes the READ address B which is to be inputted to the display memory 8 according to the control signal DIR. More particularly, the scan lines Y1, Y2 . . . Ym are scanned in the described order by the shifting operation of the uni-directional shift register 1. On the other hand, the READ address B is changed by properly setting the control signal DIR which is to be inputted to the logical operation circuit 7, thereby changing the sequence of reading display data out of the display memory 8 into the latch section 5.

Figure 10:
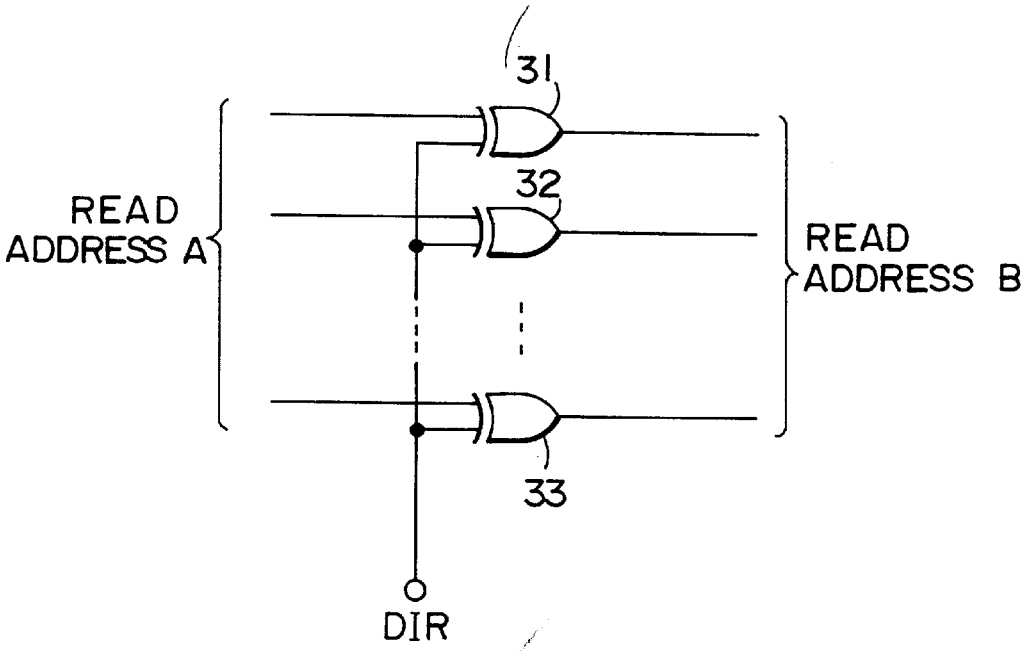
FIG. 10 is a circuit diagram of a logical operation circuit.
Figure 11:
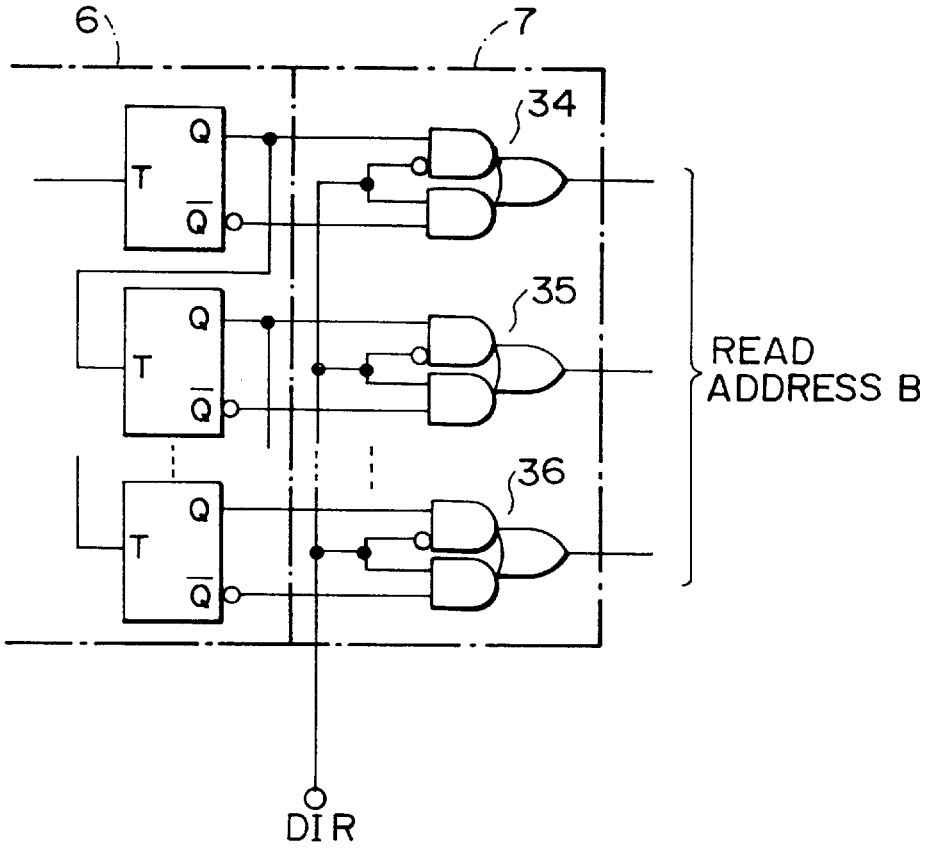
FIG. 11 is a circuit diagram of another logical operation circuit.

FIG. 10 shows a structure of the logical operation circuit. The logical operation circuit comprises a plurality of EXCLUSIVE-OR gates 31, 32 and 33. It is of course that the structure of the logical operation circuit is not limited to the one shown in FIG. 10. The logical operation circuit may take any of various forms. For example, the logical operation circuit may be formed by composite gates 34, 35 and 36 each of which is formed by combining OR gates and AND gates, as shown in FIG. 11.

Figure 12:
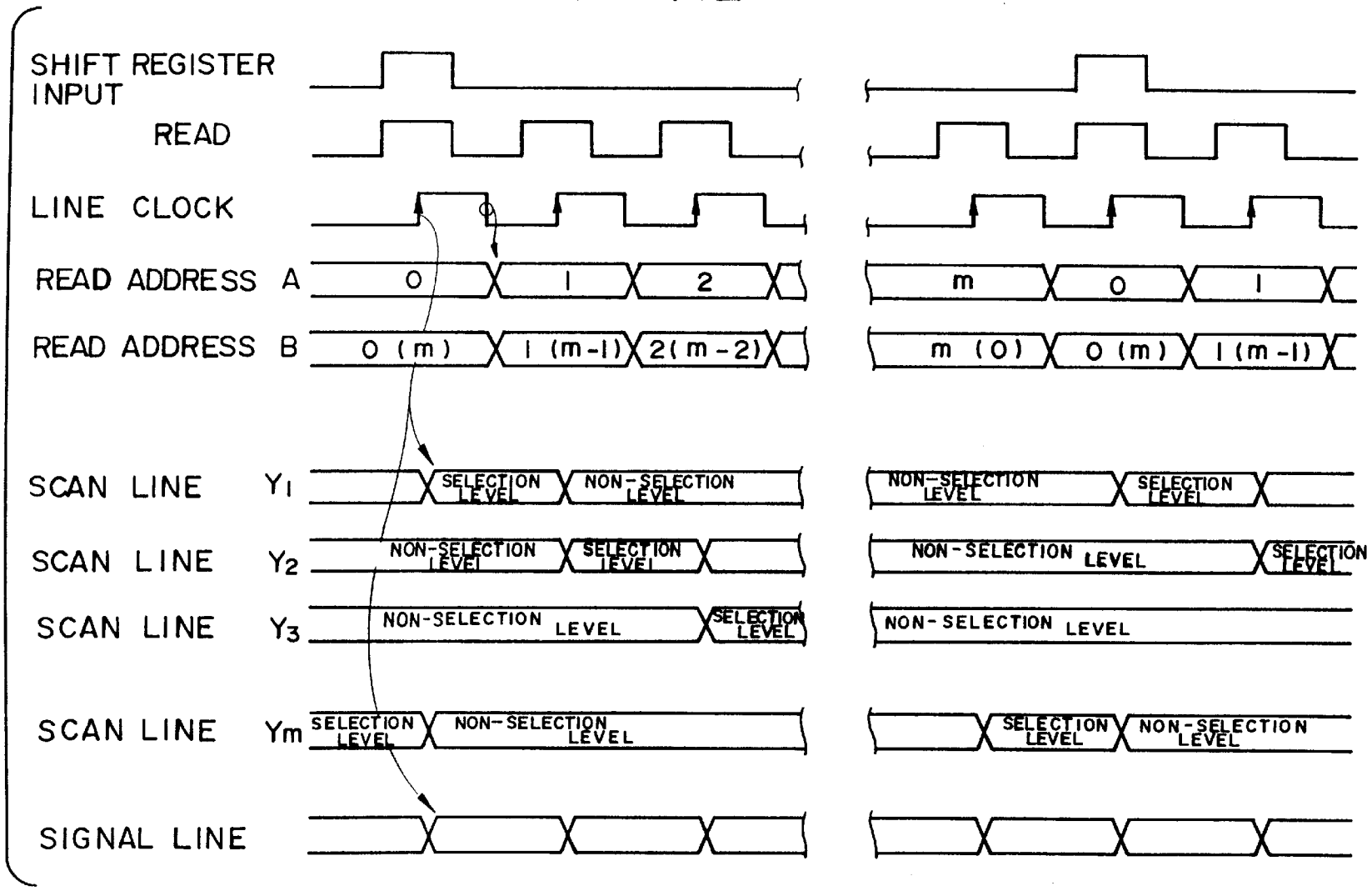
FIG. 12 is a timing chart illustrating the operation of the first embodiment.

The details of the operation of this embodiment will be described by using a timing chart shown in FIG. 12. The uni-directional shift register 1 performs the shifting operation in synchronism with the line clock. Thus, the scan lines Y1 . . . Ym connected to the scan line drive circuit 2 are sequentially set at the selection level in synchronism with the leading edge of the line clock, as shown in FIG. 12.

On the other hand, the logical operation circuit 7 may be formed by a plurality of EXCLUSIVE-OR gates, as shown in FIG. 10. If the control signal DIR is in L-level, a signal having the same level as that of the READ address A outputted from the address generating circuit 6 will be outputted directly as a READ address B. If the READ address A is zero, therefore, the display data stored at an address 0 is read out from the display memory 8 and then held by the latch section 5 at the leading edge of the line clock. The signal line drive circuit 4 then outputs a signal based on the held display data toward the signal lines X1–Xn. In this case, the address generating circuit 6 of FIG. 1 may include a counter circuit operable at the trailing edge of the line clock, for example. The counter circuit changes the READ address A in the order of 0, 1, 2, . . . m−1 and m as described. If the control signal DIR is at L-level, therefore, the READ address B which is to be inputted into the display memory 8 are also changed in the order of 0, 1, 2, . . . m−1 and m as described.

If the control signal DIR is at H-level, a signal obtained by inverting the READ address A from the address generating circuit 6 is outputted as a READ address B. In other words, the EXCLUSIVE-OR gates in the logical operation circuit 7 output signals obtained by inverting the READ address A. If the READ address A is zero and when the READ addresses A and B are of 4-bits, therefore, the READ address B becomes equal to 15. As a result, the display data stored in the display memory 8 at its address 15 is read out and then held by the latch section 5 at the leading edge of the line clock. The signal line drive circuit 4 outputs a signal based on the held display data toward the signal lines X1–Xn. If the control signal DIR is at H-level, therefore, the READ address A is changed in the order of 0, 1, 2, . . . m−1 and m as described while the READ address B is changed in the order of m, m−1, m−2, . . . 1 and 0 as described (see parts enclosed by brackets in the READ address B of FIG. 12).

As described, the liquid crystal drive unit of FIG. 1 changes the level of the READ address B outputted from the logical operation circuit 7 toward the display memory 8, depending on the level of the control signal DIR. In other words, a signal from the address generating circuit 6 is then outputted directly or inverted before outputting to the display memory 8 depending on the level of the control signal DIR. If the control signal DIR is at L-level, therefore, the display of FIG. 7A (the first display mode) is performed. If the control signal DIR is at H-level, the display of FIG. 7B (the second display mode) is made. As a result, by changing the level of the control signal DIR, the drive unit of the present invention can be adjusted to both the mounting forms shown in FIGS. 4 and 5.

Note that the control signal DIR may be generated based on the signal inputted from the external terminal of any of IC chips forming the liquid crystal display device or based on the contents of a register built in the liquid crystal drive unit. When the control signal DIR is to be generated from the external terminal signal, the latter may be fixed to the level adjusted to the mounting form (H-level or L-level). Alternatively, the external terminal signal may be controlled by any external control means such as CPU. If the control signal DIR is to be generated based on the contents of the built-in register, the latter is accessed by the CPU or the like to rewrite the contents of the built-in register for adjusting to the mounting form. Since such a type of liquid crystal drive unit requires extremely many terminals, it is advantageous that the built-in register is used to reduce the number of terminals.

Figure 13:
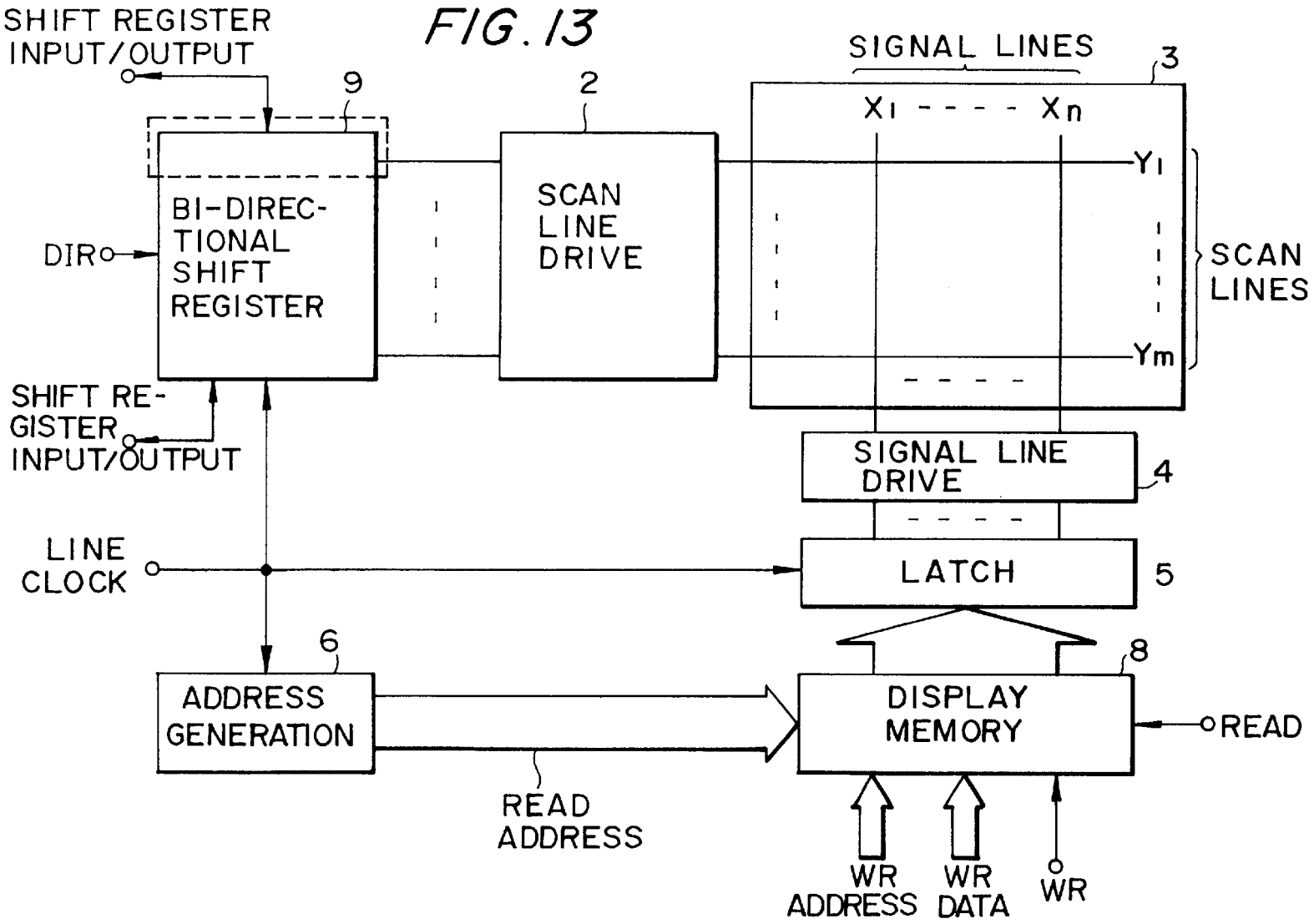
FIG. 13 is a block diagram showing the structure of a comparative form relative to the first embodiment.

FIG. 13 shows a structure of the liquid crystal drive unit which is a first comparative form in this embodiment. In comparison with FIG. 1, it will be apparent that the first comparative form does not include the logical operation circuit 7 and includes a bi-directional shift register 9 instead.

Figure 14:
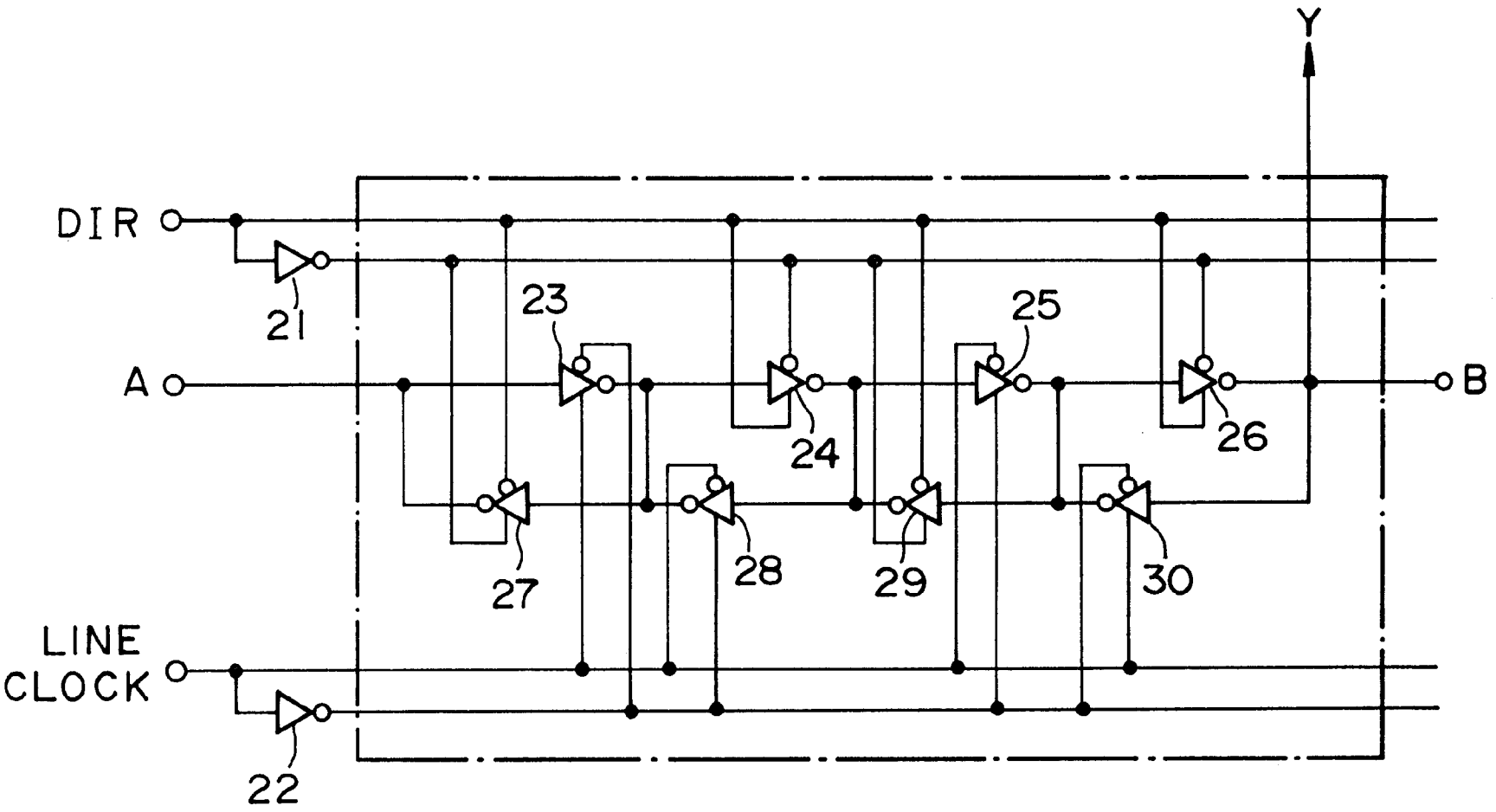
FIG. 14 is a circuit diagram of a bi-directional shift register.

FIG. 14 shows the details of a circuit for one bit in the bi-directional shift register 9 (corresponding to a portion within a broken line part in the bi-directional shift register 9 of FIG. 13). The circuit of FIG. 14 is formed by clocked gates 21–30. If the control signal DIR is at L-level, the level of a terminal A is transferred to another terminal B in this circuit at the leading edge of the line clock. If the control signal DIR is at H-level, the level of the terminal B is transferred to the terminal A at the leading edge of the line clock. In other words, the direction in which the data should be shifted is switched depending on the level of the control signal DIR.

The first comparative form of FIG. 13 must change the level of the control signal DIR to vary the direction of shift in the bi-directional shift register 9 for adjusting to the mounting forms of FIGS. 4 and 5. In FIG. 13, for example, the scan lines Y1, Y2 . . . Ym may be scanned in the order as described when the control signal DIR is at L-level. If the control signal DIR is at H-level, the scan lines Ym, Ym−1. . . Y1 will be scanned in the order as described. At this time, the display data are always read out from the display memory 8 in the order from READ address 0 to READ address m, independent of the level of the control signal DIR. The read display data are then outputted toward the signal lines. Therefore, the first comparative form of FIG. 13 can also display a vertically-inverted image on the liquid crystal display panel 3.

However, the first comparative form of FIG. 13 requires the bi-directional shift register 9 for changing the direction of scan in the scan lines. Since the number of bits in the bi-directional shift register 9 are equal to the number of scan lines, there is raised a problem in that the liquid crystal drive unit will need more area in an IC chip. For example, if the liquid crystal display panel 3 has its size called Video Graphics Array (VGA), the dot arrangement of the screen becomes 480 (vertical direction)×640 (horizontal direction). This requires the number of scan lines equal to 480. Thus, the area of the bi-directional shift register 9 becomes very large.

On the contrary, this embodiment can display an image adjusted to a mounting form without the bi-directional shift register. This enables the drive unit to be reduced in scale and cost.

There may be also considered a second comparative form which is different from the first comparative form and which comprises a first IC chip including a liquid crystal drive unit with a uni-directional shift register for scanning the scan lines in the order of Y1, Y2 . . . Ym as described, and a second IC chip including a liquid crystal drive unit with a uni-directional shift register for scanning the scan lines in the order of Ym, Ym−1. . . Y1 as described. The second comparative form can be adjusted to the different mounting forms by selecting either of the first or second IC chip as a liquid crystal drive unit which is connected to the liquid crystal display panel. However, the second comparative form must provide a plurality of drive units for adjusting to the mounting forms. This will increase the number of liquid crystal drive units or liquid crystal display devices to increase the mass-production cost and maintenance cost. Furthermore, the second comparative form requires a plurality of IC chips for adjusting to the mounting forms and thus a plurality of glass masks for the photolithography process. This will further increase the manufacturing and maintenance costs.

On the contrary, this embodiment can display an image adjusted to the mounting form without a plurality of drive units or display devices, resulting in reduction of the manufacturing and maintenance costs.

Figure 15A:
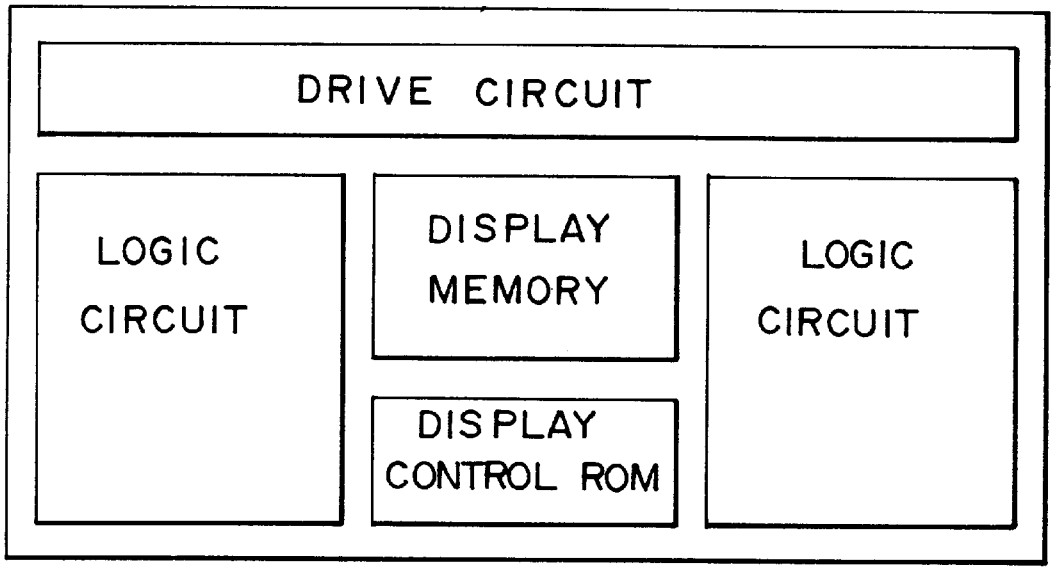
FIGS. 15A and 15B show the layouts of the related art and the first embodiment.
Figure 15B:
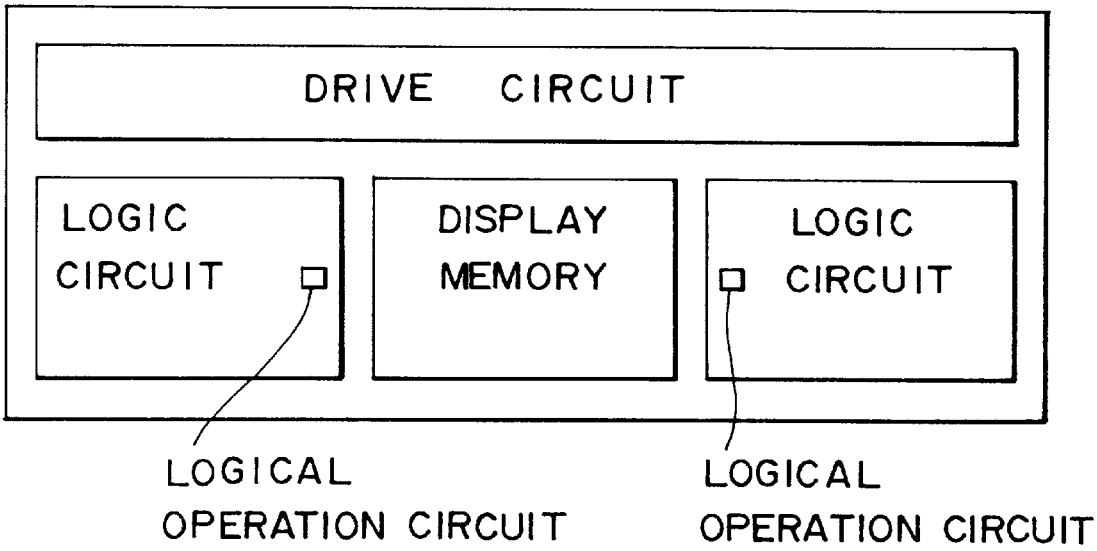

The related art disclosed in Japanese Patent Application Laid-Open No. Hei 7-152339 is similar to such a structure that the logical operation circuit 7 of FIG. 1 is replaced by a display control ROM. However, the display control ROM requires its capacity substantially equal to that of the display memory. In this case, therefore, the area of the chip extremely increases, as shown by a layout of FIG. 15A. On the other hand, this embodiment does not require any display control ROM and will need a very small area for the logical operation circuit, as shown in FIG. 15B. Thus, the area of the chip in this embodiment is extremely smaller than that of FIG. 15A. In the case of FIG. 15A, furthermore, all transistors forming the display control ROM must be arranged into one unit, so that the freedom of layout is limited. On the contrary, the logical operation circuit can be arranged within a logical circuit through automated placing and routing procedures. Therefore, the logical operation circuit does not limit the freedom in layout. Consequently, this embodiment can further reduce the area of the chip.

Recently, it is particularly desired that the voltage used by the liquid crystal drive unit is reduced for requirement of low power to the liquid crystal display device. Thus, a high voltage resistant element requiring a larger area is not being used and a drive circuit section (e.g., scan line drive circuit, signal line drive circuit or the like) has been reduced in scale, as shown in FIGS. 15A and 15B. Therefore, it becomes important that an area other than the drive circuit section is reduced. According to this embodiment, the shift register can be reduced in scale and a logical operation circuit smaller than the display control ROM can be used. This can solve the above-mentioned problem.

Furthermore, in the above related art, the stored contents of the display control ROM must be changed for each of the types of liquid crystal drive units or liquid crystal display devices. This will increase the manufacturing cost and the number of glass masks for the photolithography process. On the contrary, in this embodiment, the READ address in the display memory can be changed by the control signal DIR. Thus, a single liquid crystal drive unit can be adjusted to various mounting forms, resulting in reduction of the maintenance cost and the number of glass masks for the photolithography process.

Figure 16:
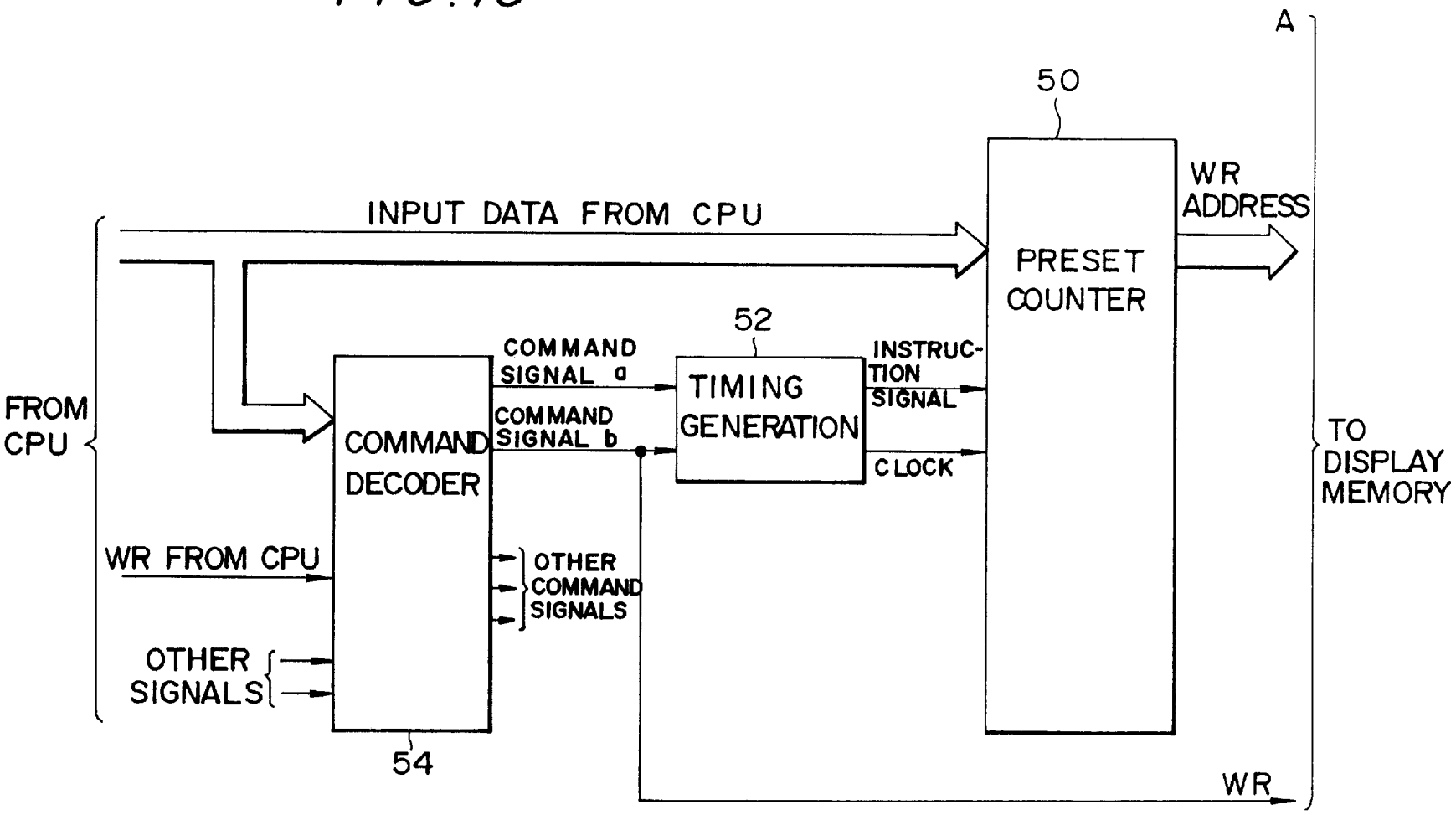
FIG. 16 shows a circuit for automatically incrementing a WR address.

In this embodiment, the WR address is automatically incremented (or decremented) each time when the CPU (or external control means) writes WR data into the display memory 8 after the initial address has been set. Since the WR address is automatically incremented without additional addressing after the initial address has been set, the burden on the CPU can be greatly reduced. FIG. 16 shows a circuit for accomplishing such an automatic increment of WR address.

A command decoder 54 analyzes WR and other signals from the CPU to determine whether input data from the CPU is an initial address or write data to the display memory 8. If it is determined by the command decoder 54 that the input data from the CPU is an initial address, the command decoder 54 outputs a command signal a toward a timing generating circuit 52. The timing generating circuit 52 receives the signal, and then generates an instruction signal for instructing the preset counter 50 to preset. The preset counter 50 then determines that the input data from the CPU is an initial address, and uses a clock from the timing generating circuit 52 to preset the initial address.

On the other hand, if the command decoder 54 determines that the input data from the CPU is write data to the display memory 8, the command decoder 54 outputs a command signal b toward the timing generating circuit 52. The timing generating circuit 52 receives the signal and then generates an instruction signal for instructing the preset counter 50 to increment the WR address. The preset counter 50 then uses a clock from the timing generating circuit 52 to increment the WR address. In such a manner, the WR address will be sequentially incremented and outputted toward the display memory 8.

Thus, the automatic increment of WR address can be carried out. In this embodiment, the same operation that is done for the WR address is performed for the READ address A which is the output of the address generating circuit 6. In other words, the READ address A is sequentially incremented as the WR address. When the control signal DIR is at H-level to switch the mode of display from the first display mode to the second display mode (for vertical inversion), the logical operation circuit 7 performs another operation reverse to the operation performed for the WR address for the READ address B. In other words, the READ address B is sequentially decremented contrary to the WR address.

As described, this embodiment can simplify the writing/reading process relative to the display memory 8 since the same operation is performed for the WR address and the READ address in the display memory 8. Thus, the logical operation circuit 7 can be adjusted to the switching of display mode simply by changing the operation for the READ address. Therefore, the logical operation circuit 7 can be simplified in structure while the number of logic gates in the logical operation circuit 7 can be decreased. Since the WR address is automatically incremented, the burden on the CPU can also be relieved.

(Second Embodiment)

Figure 17:
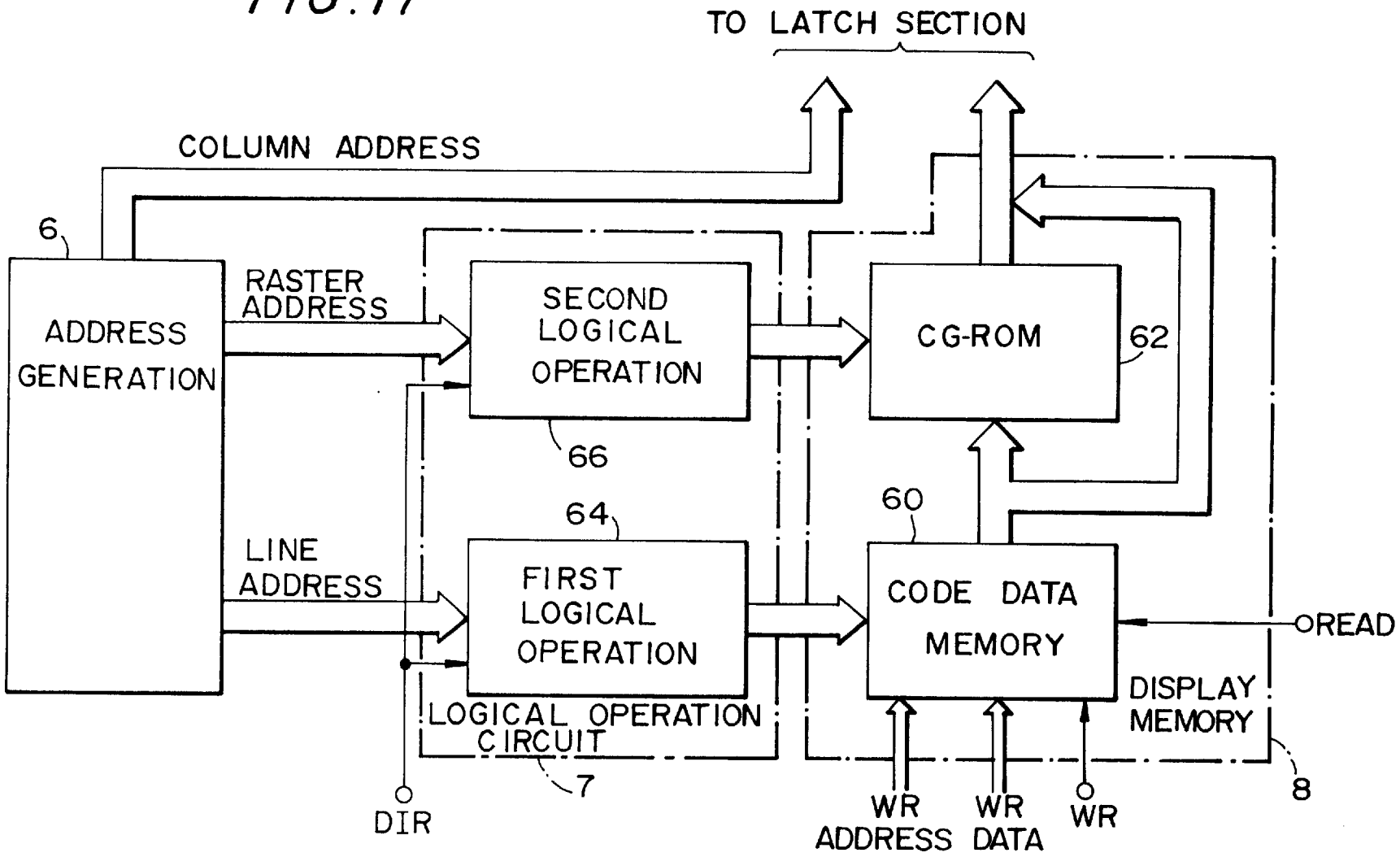
FIG. 17 is a block diagram of a liquid crystal drive unit of a second embodiment of the present invention.

FIG. 17 shows a liquid crystal drive unit of a second embodiment of the present invention in which the display memory 8 includes a code data memory 60 and a character generator (CG) ROM 62 and in which the logical operation circuit 7 includes first and second logical operation circuits 64, 66. The code data memory 60 stores character code data or the like. The CG-ROM 62 stores a pattern data specified by the character code data.

Figures 18A, 18B:
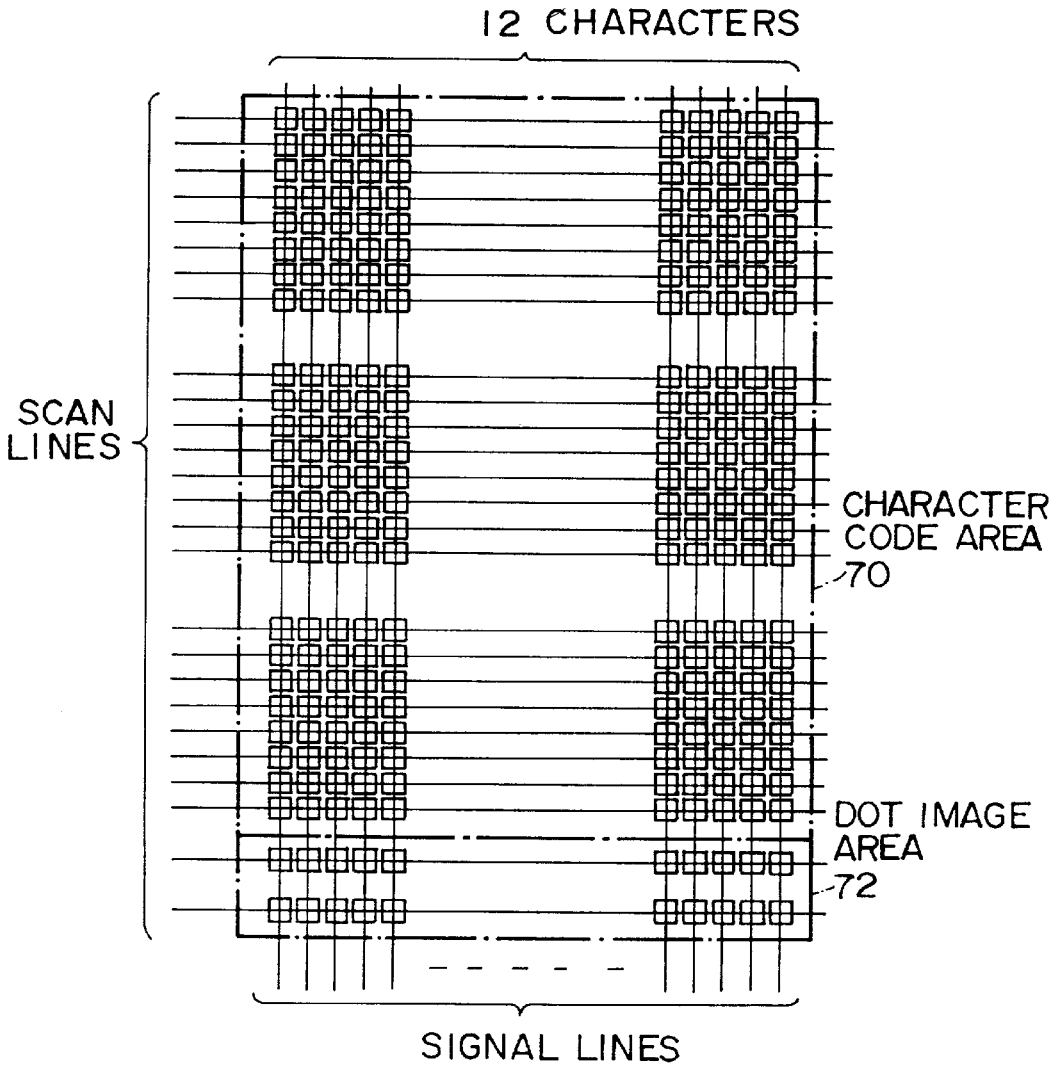
FIGS. 18A and 18B illustrate a memory map of the display memory.

FIG. 18A shows an example of a memory map in the code data memory 60. In this embodiment, the code data memory 60 stores character code data corresponding to twelve characters at each of line addresses 0–2 and also stores dot image data at each of line addresses 3 and 4. As shown in FIG. 18B, thus, characters equal to 36=3×12 can be displayed in a character code area 70 while any image desired by a user can be displayed in a dot image area 72.

Figure 19:
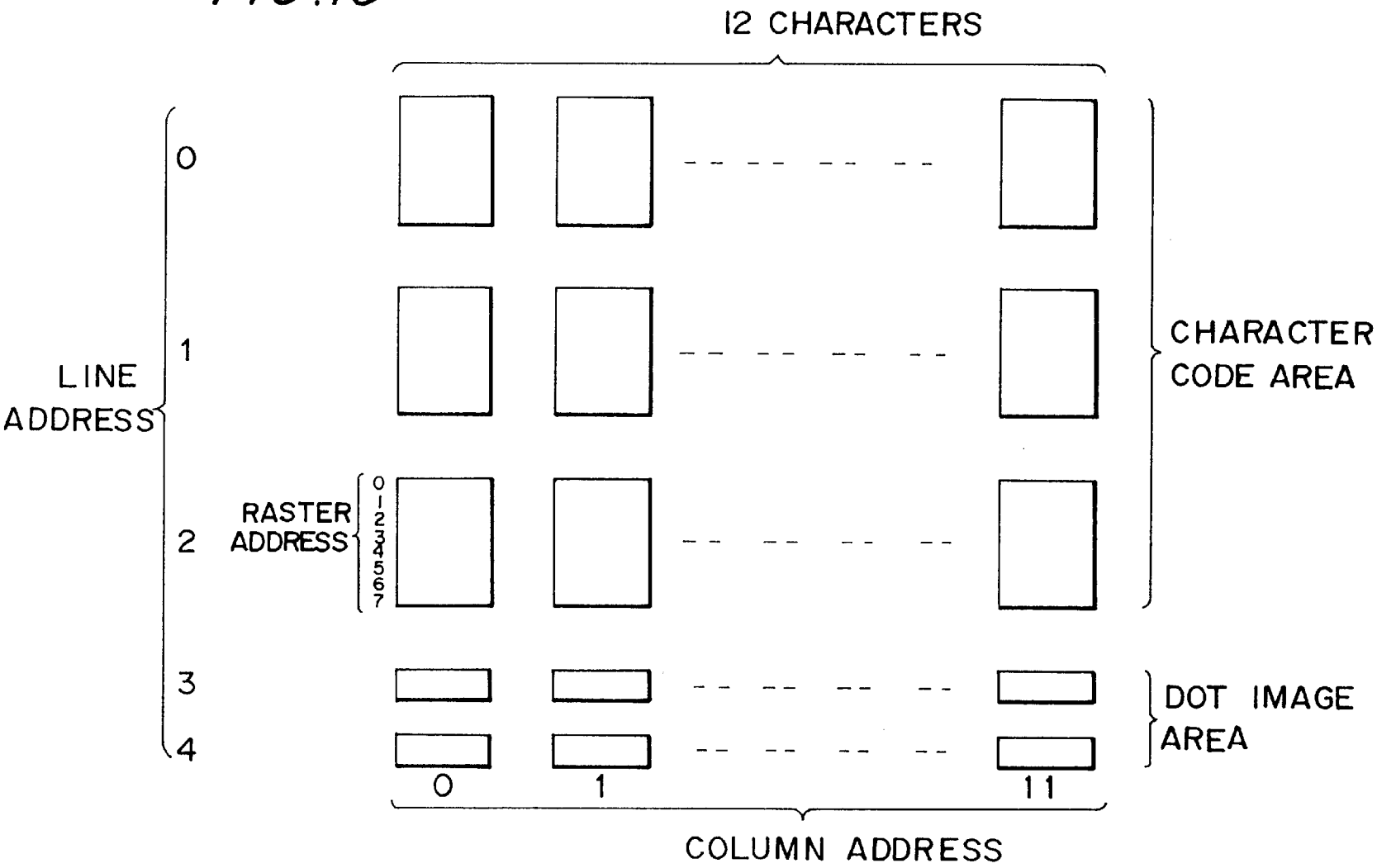
FIG. 19 illustrates a column address, a raster address and a line address.

FIG. 19 shows the relationship between column address, raster address and line address. The column address is used to specify a column on which a character is displayed, and is varied between 0 and 11 in this embodiment. The raster address is used to specify a line of dots forming each character, and is changed between 0 and 7 in this embodiment. The line address is used to specify a line on which the character and dot image are displayed, and is varied between 0 and 4 in this embodiment. In this embodiment, the raster address is changed by one if the raster address becomes 11. The line address is varied by one if the raster address becomes 7.

These line, raster and column addresses are generated by the address generating circuit 6, as shown in FIG. 17. The line address is outputted toward the first logical operation circuit 64; the raster address toward the second logical operation circuit 66; and the column address toward the latch section. The first logical operation circuit 64 converts the inputted line address and the converted line address is in turn outputted toward the code data memory 60. On the other hand, the second logical operation circuit 66 converts the inputted raster address and the converted raster address is in turn outputted toward the CG-ROM 62.

Figures 20A, 20B:
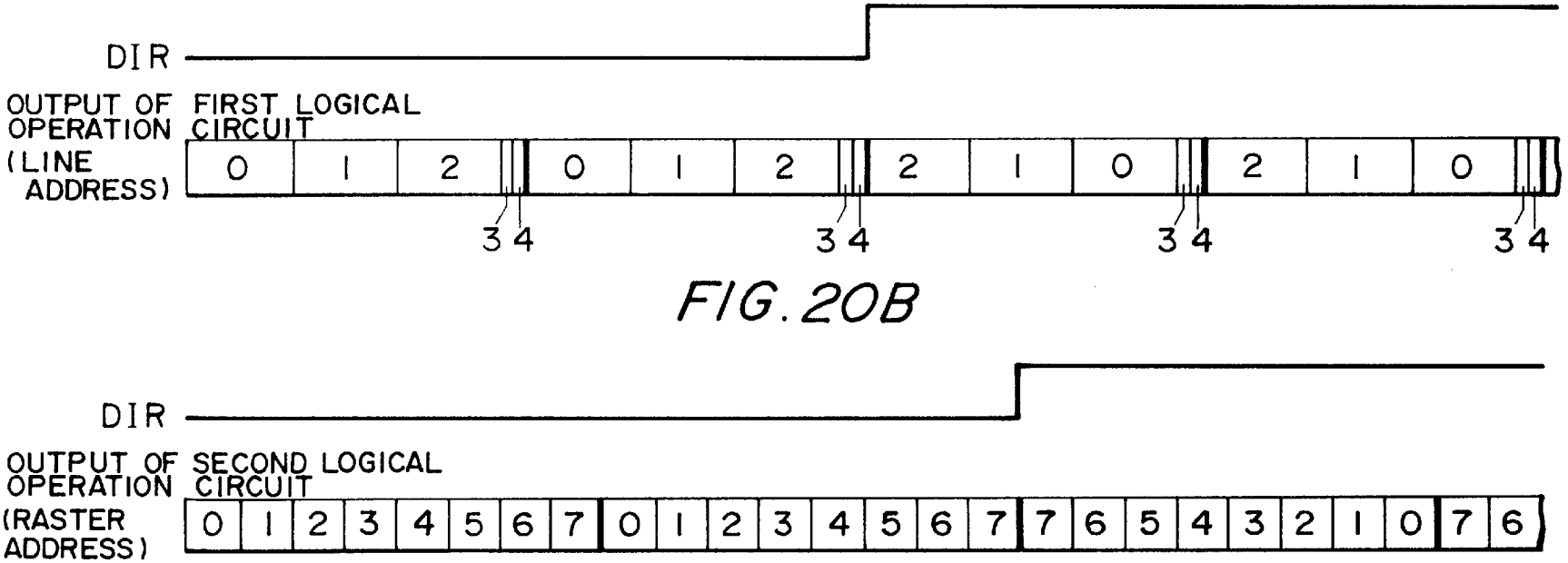
FIG. 20 is a timing chart illustrating the operation of the second embodiment.

The operation of this embodiment will be described in connection with FIGS. 20A and 20B. When the control signal DIR is at L-level, the first logical operation circuit 64 outputs the line address from the address generating circuit 6 toward the code data memory 60 without any conversion, as shown in FIG. 20A. In other words, if the line address changes in the order of 0, 1, 2, 3 and 4 as described, the output of the first logical operation circuit 64 also changes in the same order. On the other hand, when the control signal DIR is at H-level, the first logical operation circuit 64 inverts the line address and outputs the inverted line address toward the code data memory 60. However, the line address 3 and 4 for the dot image data will not be inverted. In other words, if the line address changed in the order of 0, 1, 2, 3 and 4 as described, the output of the first logical operation circuit 64 changes in the order of 2, 1, 0, 3 and 4 as described.

When the control signal DIR is at L-level, the second logical operation circuit 66 outputs the raster address from the address generating circuit 6 toward the CG-ROM 62 without any conversion, as shown in FIG. 20B. In other words, if the raster address changes in the order of 0, 1, 2 . . . 7 as described, the output of the second logical operation circuit 66 also changes in the same order. If the control signal DIR is at H-level, the second logical operation circuit 66 inverts the raster address and outputs the inverted raster address toward the CG-ROM 62. In other words, if the raster address changes in the order of 0, 1, 2 . . . 7 as described, the output of the second logical operation circuit 66 changes in the order of 7, 6, 5 . . . 0 as described.

Figure 7A:
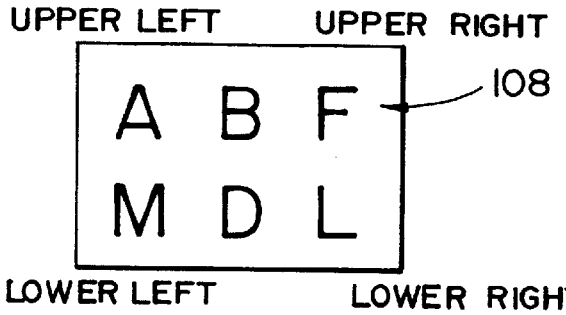
FIGS. 7A–7D illustrate the inversion of the display image.
Figure 7B:
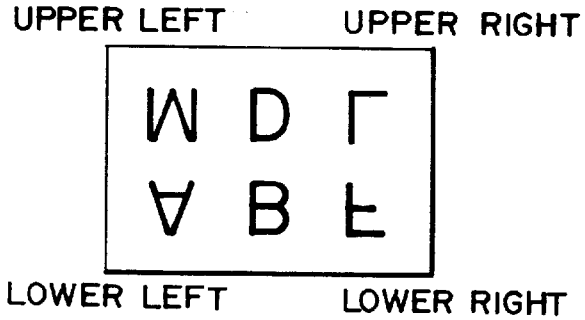
Figure 7C:
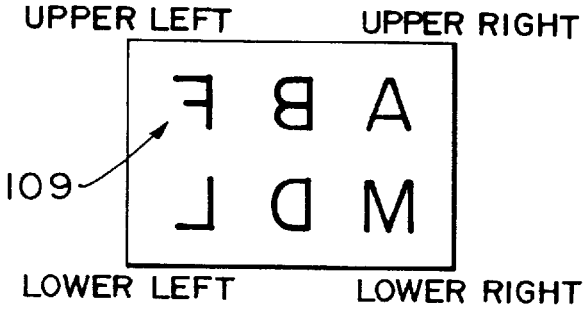
Figure 7D:
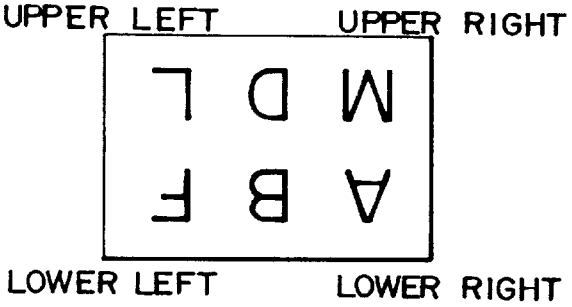

As described, this embodiment can switch between the first display mode of FIG. 7A and the second display mode (for the vertical inversion) of FIG. 7B simply by changing the level of the control signal DIR. Thus, this embodiment can be adjusted to the mounting forms shown in FIGS. 4 and 5. According to this embodiment, particularly, the common control signal DIR can be used in both the first and second logical operation circuits 64, 66. This simplifies the control. Since both the first and second logical operation circuits 64, 66 can be formed by logic gates rather than the display control ROM, the area of the chip can be optimized. Although the related art disclosed in the Japanese Patent Application Laid-Open No. Hei 7-152339 performs the vertical inversion of character by rewriting the stored contents of the CG-ROM, this requires two types of the drive units for the first and second display modes, resulting in increase of the maintenance cost.

(Third Embodiment)

Figure 21:
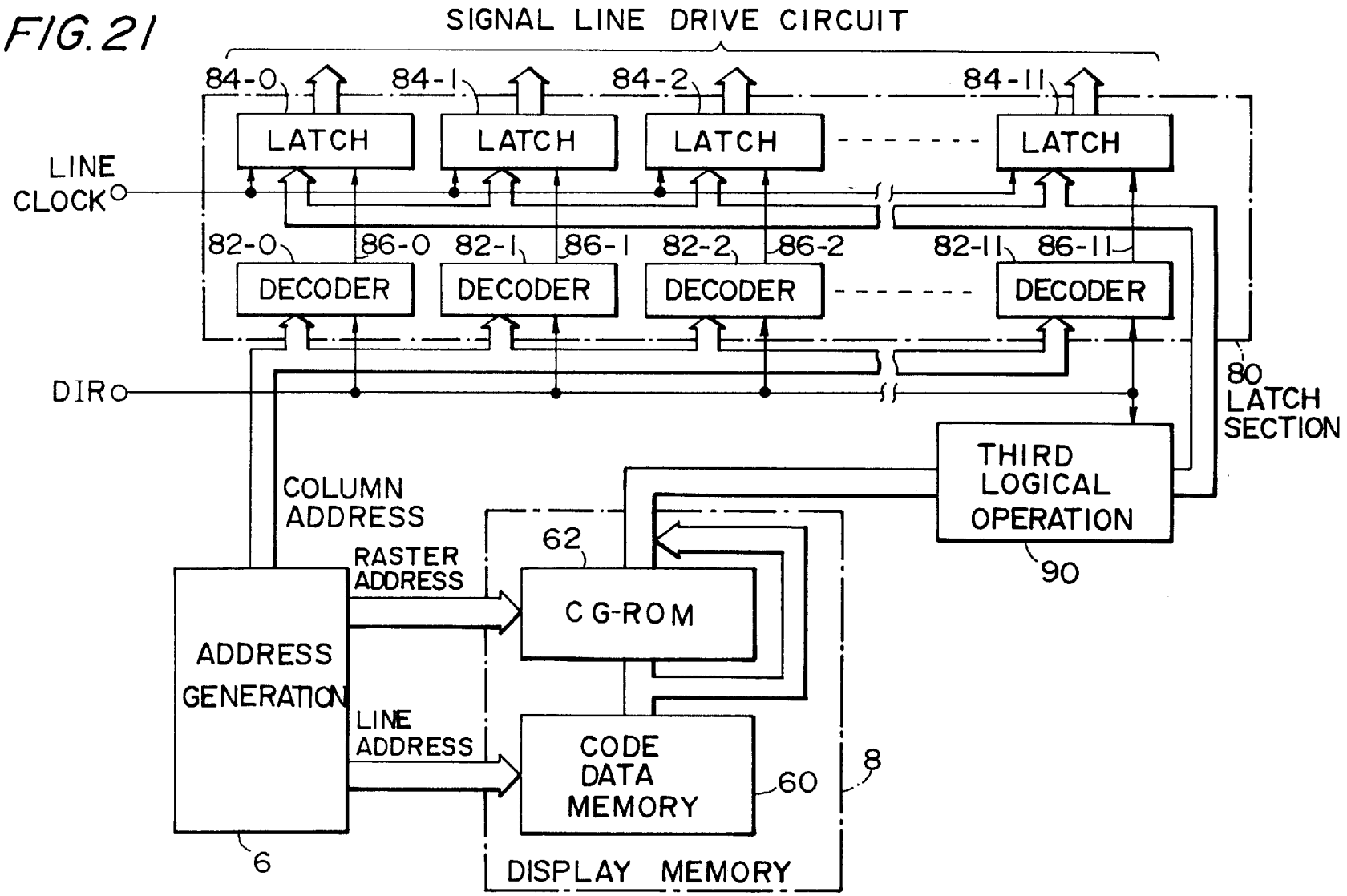
FIG. 21 is a block diagram of a liquid crystal drive unit of a third embodiment of the present invention.

FIG. 21 shows a liquid crystal drive unit of a third embodiment of the present invention which comprises an additional or third logical operation circuit 90 and a latch section 80. The latch section 80 comprises decoders 82-0 to 82-11 and latches 84-0 to 84-11.

Figures 22A, 22B:
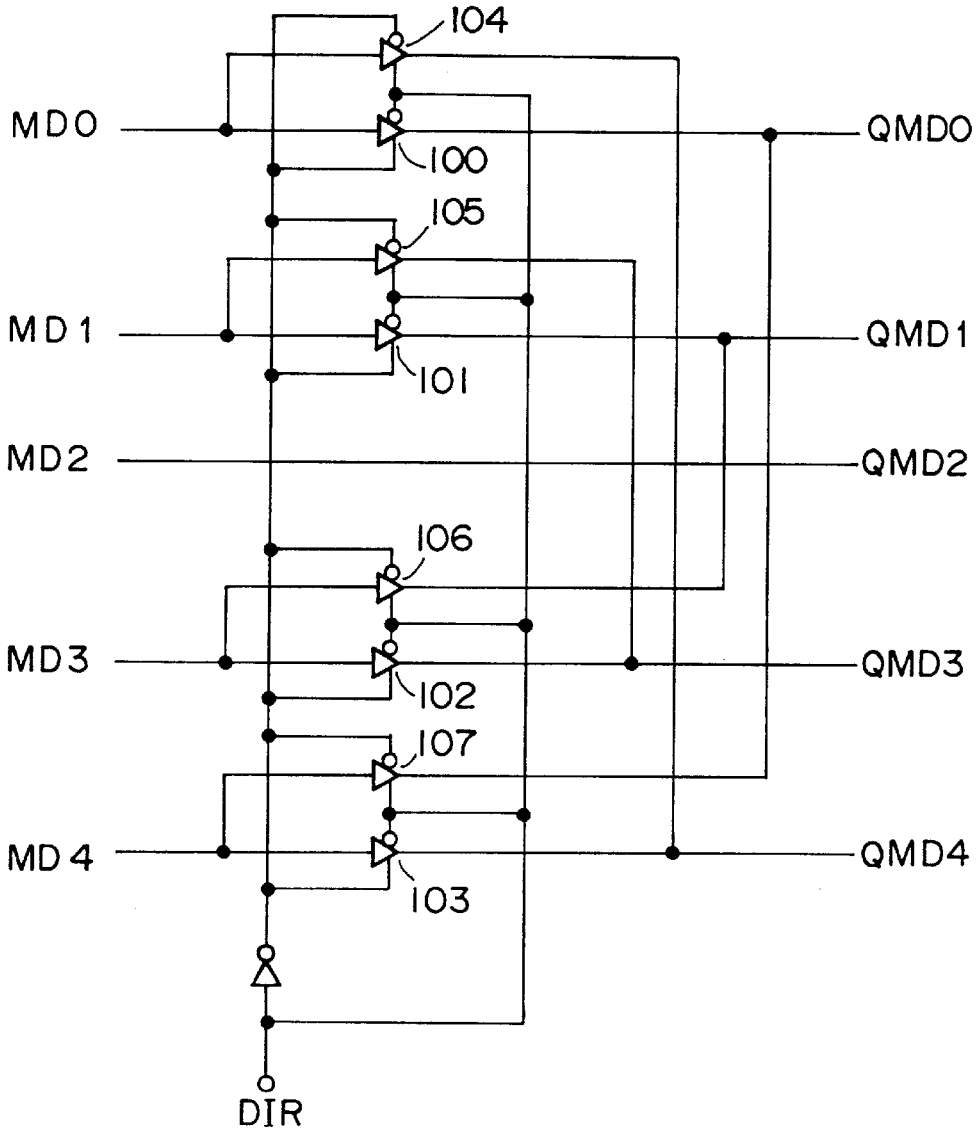
FIG. 22A is a circuit diagram of a third logical operation circuit.
FIG. 22B is a truth table of this third logical operation circuit.

FIG. 22A shows a circuit of the third logical operation circuit 90 which comprises a plurality of clocked gates 100–107. If the control signal DIR is at L-level, the lower clocked gates 100–103 are selected. Thus, the terminals MD0–MD4 are connected to terminals QMD0–QMD4, respectively, as shown in a truth table of FIG. 22B. On the other hand, if the control signal DIR is at H-level, the upper clocked gates 104–107 are selected. Thus, the terminals MD4, MD3, MD2, MD1 and MD0 are connected to the terminals QMD0, QMD1, QMD2, QMD3 and QMD4, respectively. When the third logical operation circuit 90 receives the output of the CG-ROM 62 in such a manner, each character can be laterally inverted. For example, an "F" character numbered 108 in FIG. 7A can be laterally inverted to the character numbered 109 in FIG. 7C. When the control signal DIR is at L-level, the character will not be laterally inverted. If the control signal DIR is at H-level, the character will be laterally inverted as shown in FIGS. 7A and 7B.

The output of the third logical operation circuit 90 is connected to the latches 84-0 to 84-11 which fetch and hold the output of the third logical operation circuit 90 when latch signals (fetching signals) 86-0 to 86-11 are at H-level. When the line clock becomes H-level, the held data is outputted toward the signal line drive circuit.

Figure 23:
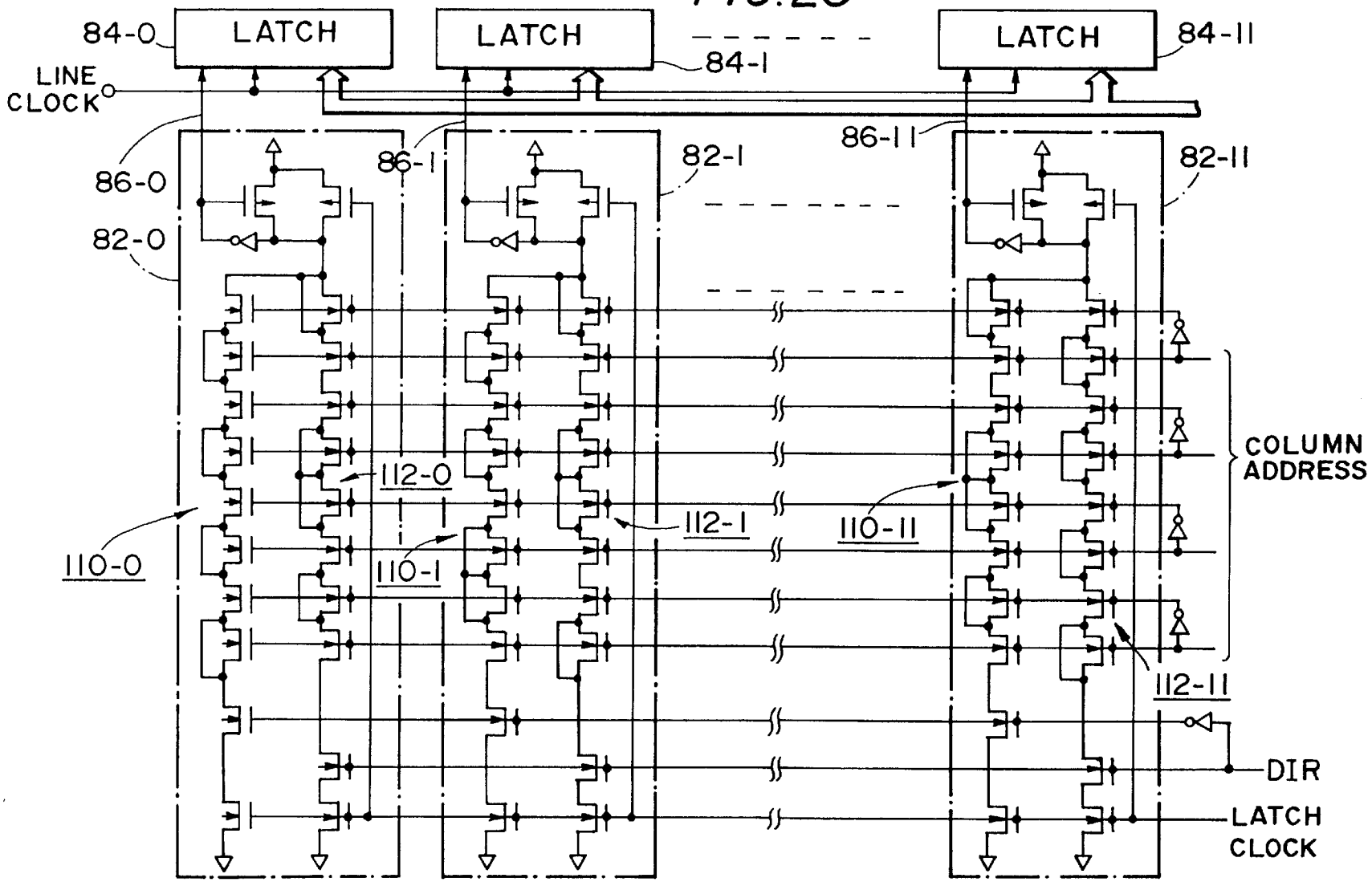
FIG. 23 shows the structure of decoders.

The decoders 82-0 to 82-11 receive the control signal DIR and also a column address from the address generating circuit 6. The decoders 80-0 to 82-11 decode the inputted column address to generate the latch signals 86-0 to 86-11 which are in turn outputted toward the latches 84-0 to 84-11. FIG. 23 shows the details of the decoders 82-0 to 82-11. In the decoder 82-0, for example, when the control signal DIR is at L-level, a leftward column 110-0 of the N-channel transistors is selected. When the control signal DIR is at H-level, a rightward column 112-0 of the N-channel transistors is selected. When the column address is incremented, a leftward column 110-1 in the decoder 82-1 is selected if the control signal DIR is at L-level while a rightward column 112-1 is selected if the control signal DIR is at H-level. This is true *of the other decoders 82-2 to 82-11.

For example, when the control signal DIR becomes L-level to select the leftward column 110-0 in which all the N-channel transistors connected to the column address are turned on and if the latch clock becomes H-level, the latch signal 86-0 becomes H-level. When the control signal DIR becomes H-level to select the rightward column 112-0 in which all the N-channel transistors connected to the column address are turned on and if the latch clock becomes H-level, the latch signal 86-0 similarly becomes H-level. This is true of the other decoders 82-1 to 82-11.

Figure 24:
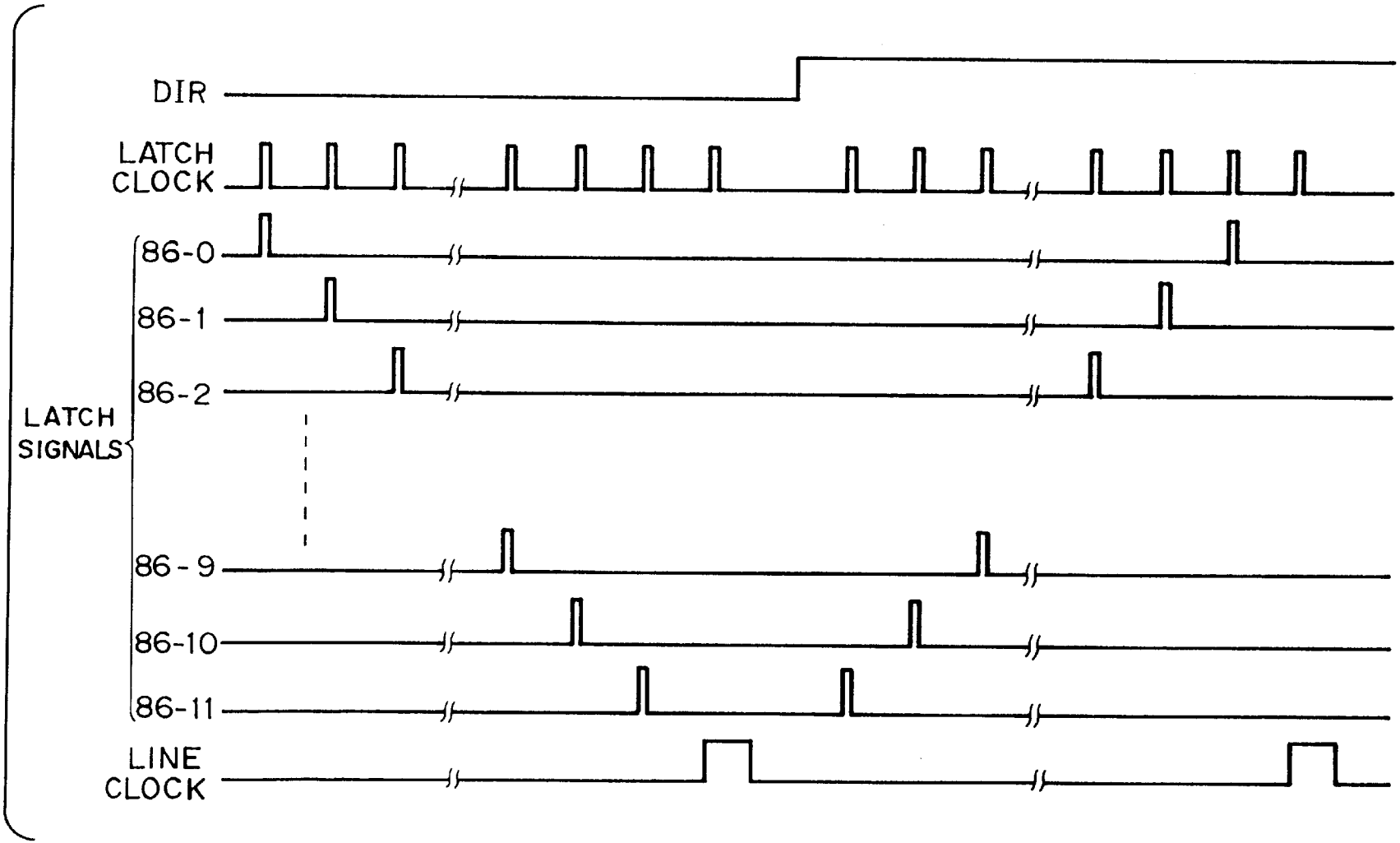
FIG. 24 is a timing chart illustrating the operation of a third embodiment.

Next, the operation of this embodiment will be described in connection with a timing chart shown in FIG. 24. When the control signal DIR is at L-level, the third logical operation circuit 90 of FIG. 21 will not perform the lateral inversion for each character. In the decoders 82-0 to 82-11, leftward columns 110-1 to 110-11 are selected. As the column address is sequentially incremented, the latch signals sequentially rise in the order of 86-0, 86-1, 86-2 . . . 86-11 as described at each time when the latch clock rises, as shown in FIG. 24. Thus, the latches fetch and hold the output of the third logical operation circuit 90 by five bits at a time in the order of the latches 84-0, 84-1, 84-2 . . . 84-11 as described. When the line clock finally rises, the data held by the latches 84-0 to 84-11 are outputted toward the signal line drive circuit. In such a manner, the display will be performed in the first display mode, as shown in FIG. 7A.

When the control signal DIR is at H-level, the third logical operation circuit 90 of FIG. 21 performs the lateral inversion for each character. In the decoders 82-0 to 82-11, the rightward columns 112-0 to 112-11 are selected. As the column address is sequentially incremented, the latch signals sequentially rise in the order of 86-11, 86-10, 86-9 . . . 86-0 as described at each time when the latch clock rises, as shown in FIG. 24. Thus, the latches fetch and hold the laterally-inverted character pattern data for each character (or the output of the third logical operation circuit 90) by five bits at a time in the order of the latches 84-11, 84-10, 84-9 . . . 84-0 as described. When the line clock finally rises, the data held by the latches 84-0 to 84-11 are outputted toward the signal line drive circuit. In such a manner, the display will be made in the third display mode (for the lateral inversion) shown in FIG. 7C. In other words, the displays of FIGS. 7A and 7C can be switched from one to another simply by changing the level of the control signal DIR.

Figure 25:
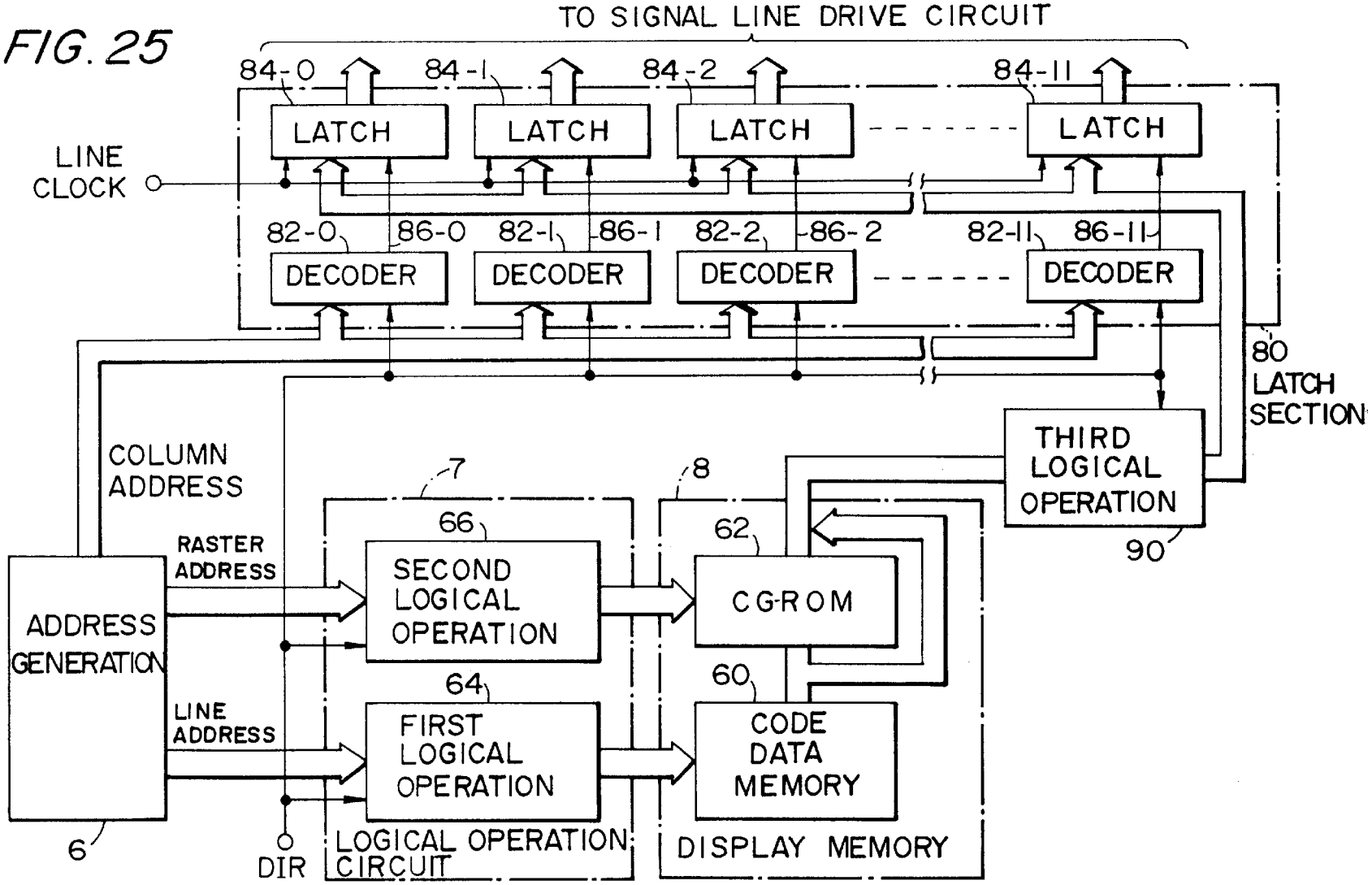
FIG. 25 is a block diagram of a modified form of the third embodiment.

FIG. 25 shows a modified form of the third embodiment in which the logical operation circuit 7 including the first and second logical operation circuits 64, 66 is added to the structure of FIG. 21. Thus, the vertical inversion as well as the lateral inversion can be performed as described in connection with the second embodiment. When these inversions are combined, such a vertical and lateral inversion (180 degrees inversion) as shown in FIG. 7D can be carried out. Therefore, this modified form can be adjusted to a mounting form as shown in FIG. 6.

According to this embodiment, an image may be displayed in the lateral inversion or the vertical and lateral inversion without large increase of the circuit size, and the liquid crystal drive unit can be adjusted to various mounting forms. According to this embodiment, a common control signal DIR can be used between the first, second and third logical operation circuits 64, 66, 90 and the decoders 82-0 to 82-11. Therefore, the control can be simplified. When the structure of FIG. 25 is used, particularly, all the vertical, lateral, and vertical and lateral inversions can be carried out and the liquid crystal drive unit can be adjusted to all the mounting forms of FIGS. 4, 5 and 6.

(Fourth Embodiment)

Figure 26:
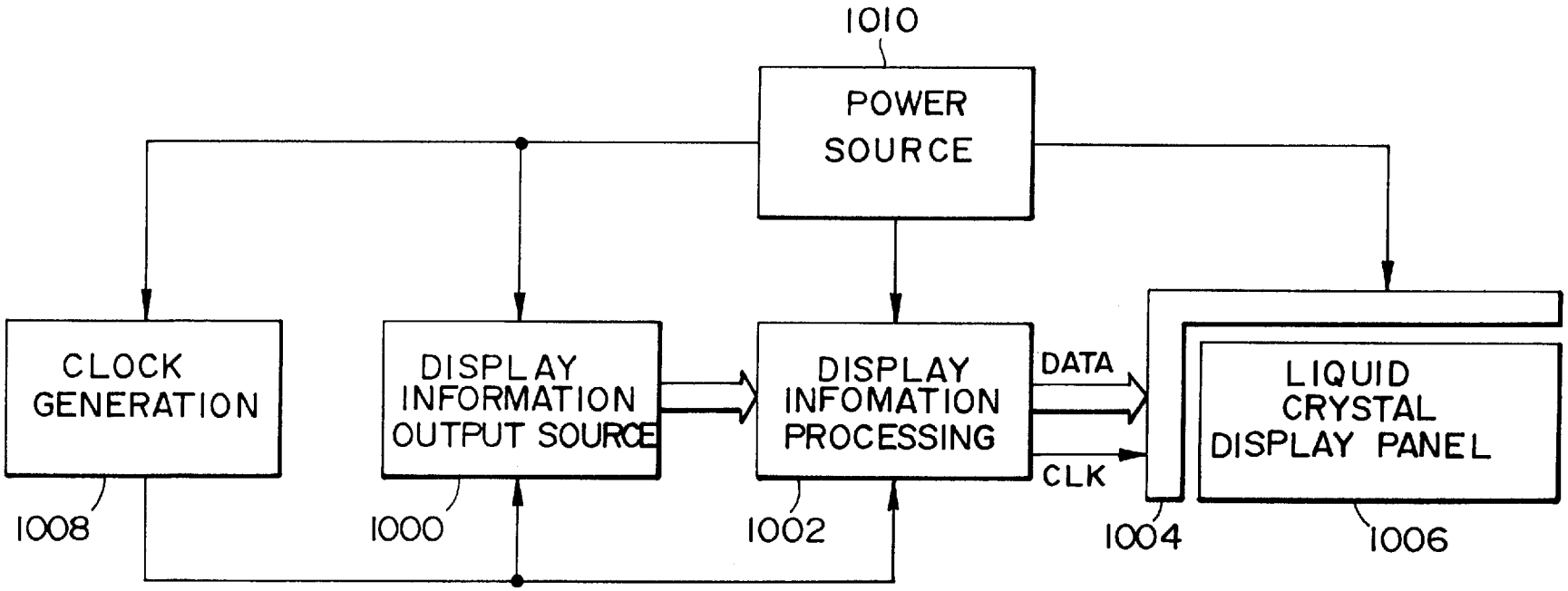
FIG. 26 is a block diagram of an electronic equipment in a fourth embodiment.

FIG. 26 shows an electronic equipment of the fourth embodiment of the present invention, including the liquid crystal drive unit as described in connection with the first to third embodiments. The electronic equipment of FIG. 26 comprises a display information output source 1000, a display information processing circuit 1002, a liquid crystal drive unit 1004 as described in connection with the first to third embodiments, a liquid crystal display panel 1006 which is one of the display panels, a clock generating circuit 1008 and a power source circuit 1010. The display information output source 1000 includes memories such as ROM or RAM, a tuning circuit and other components, and is responsive to a clock from the clock generating circuit 1008 to output display information such as a video signal. The display information processing circuit 1002 is responsive to the clock from the clock generating circuit 1008 to process and output the display information. The display information processing circuit 1002 may include an amplifying/polarity inverting circuit, a phase shift circuit, a rotation circuit, a gamma correction circuit or a clamping circuit. The drive unit 1004 includes a scan line drive circuit, a signal line drive circuit and other circuits, and drives the liquid crystal display panel 1006. The power source circuit 1010 supplies a power to the above-mentioned circuits.

Figure 27A:
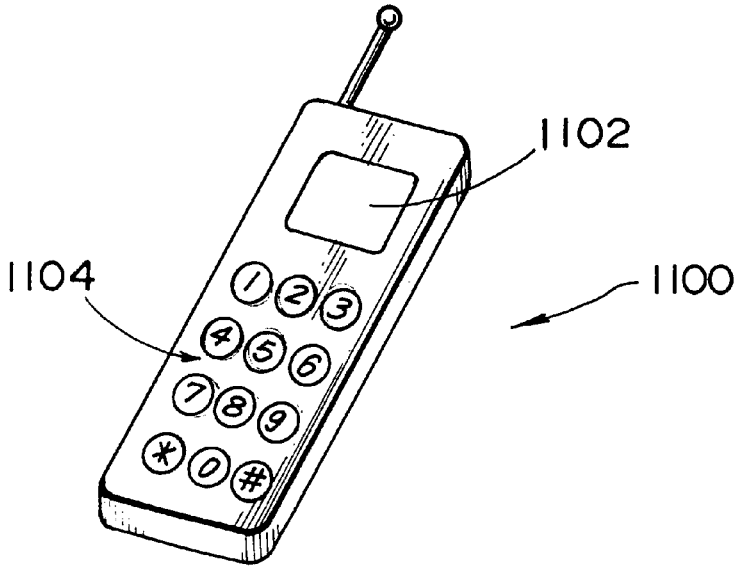
FIG. 27A shows a portable telephone.
Figure 27B:
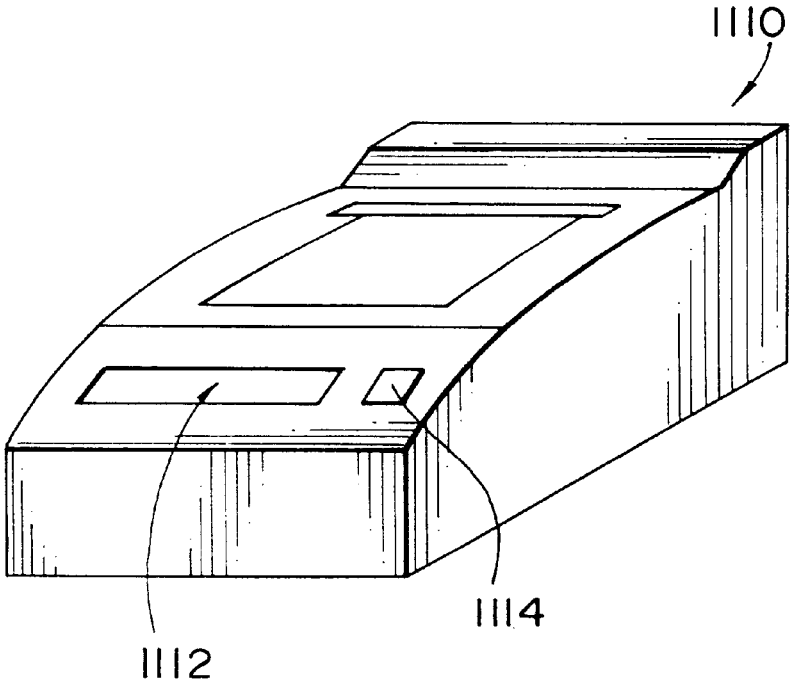
FIG. 27B shows a printer.
Figure 28:
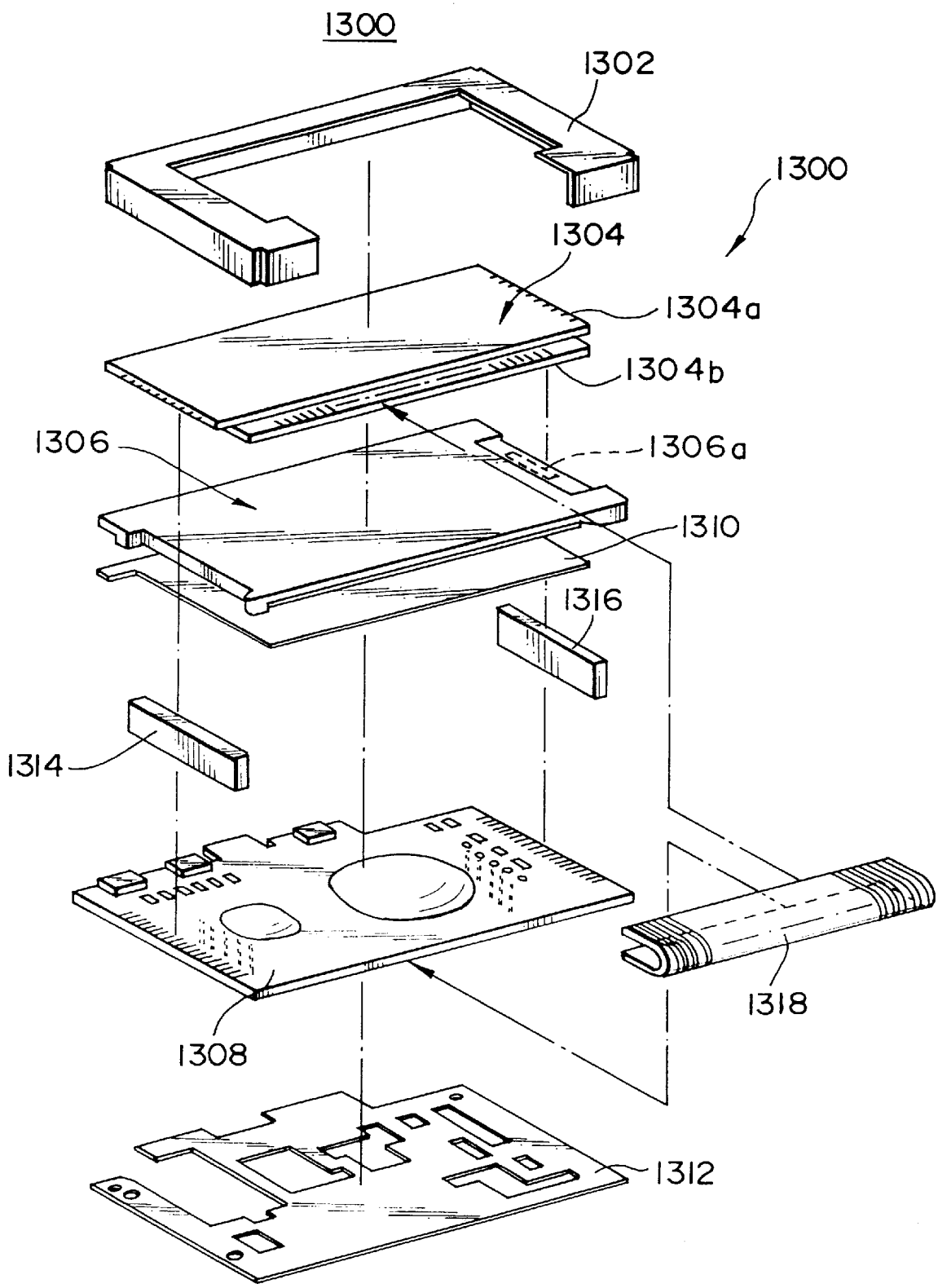
FIG. 28 shows a pager.

Such electronic equipment may include a portable telephone as shown in FIG. 27A, a printer as shown in FIG. 27B, a pager as shown in FIG. 28, PHS, a cellular phone, audio equipment, an electronic notebook, a pocket calculator, a terminal for the point of sales (POS) system, a device having a touch panel, a projector, a word processor, a personal computer, a television, a view finder or monitor type video tape recorder, a car navigation device and others.

The portable telephone shown in FIG. 27A comprises a display section 1102 and push buttons 1104. The printer 1110 shown in FIG. 27B comprises a display section 1112 and a control panel 1114. These display sections 1102 and 1112 can perform the display using the liquid crystal drive unit as described in connection with the first to third embodiments.

The pager 1300 shown in FIG. 28 comprises a metal frame 1302 which includes a liquid crystal display board 1304, a light guide 1306 having a back light 1306*a*, a circuit board 1308, first and second shield plates 1310, 1312, two elastic conductors 1314 and 1316 and a film carrier tape 1318. The two elastic conductors 1314, 1316 and film carrier tape 1318 connect the liquid crystal display board 1304 with the circuit board 1308.

The liquid crystal display board 1304 is formed by sandwiching liquid crystal between two transparent boards 1304*a* and 1304*b* to provide a dot matrix type liquid crystal display panel. The liquid crystal drive unit 1004 or the display information processing circuit 1002 in FIG. 26 in addition to the drive unit 1004 may be mounted on one of the transparent boards. In FIG. 28, any external circuit other than the circuits mounted on the liquid crystal display board 1304 can be mounted on the circuit board 1308.

The pager shown in FIG. 28 requires the circuit board 1308 in addition to the liquid crystal display board 1304. When the liquid crystal display device is used as part of the electronic equipment and if the drive unit is mounted on one of the transparent boards, the liquid crystal display board 1304 can be considered to be a minimum liquid crystal display device. Alternatively, the liquid crystal display board 1304 may be fixed in the metal frame 1302 or a housing and they can be used as a liquid crystal display device which is part of the electronic equipment. In case that the electronic equipment is a back-lighted type, the liquid crystal display device may be formed by the metal frame 1302 which includes the liquid crystal display board 1304 and the light guide 1306 having the back light 1306*a*.

The present invention is not limited to any of the above first to fourth embodiments, and various modifications can be made within the scope of the invention.

For example, the present invention is not limited to the one-bit control signal as described in the embodiments, but may be applied to any multiple-bits control signal. In such a case, the switching can be carried out between three display modes.

Although the embodiments have been described as to the output of the address generating circuit that is directly used as an address in the first display mode, the present invention is not limited to such an arrangement, and may be applied to use any processed output from the address generating circuit as an address in the first display mode.

The structure of the logical operation circuit is not limited to any of the illustrated and described forms, but may be modified into any of various other forms.

If the first to third embodiments of the present invention are combined, the switching not only between two display modes but also between three display modes can be carried out. This can realize an improved adjustment to various mounting forms.

Although the embodiments have been described mainly as to an application to the liquid crystal drive unit or the liquid crystal display device, the present invention is not limited to such forms, and may be similarly applied to a drive unit or display device using an electroluminescence (EL), vacuum fluorescent display (VFD) or the like.

Figure 29:
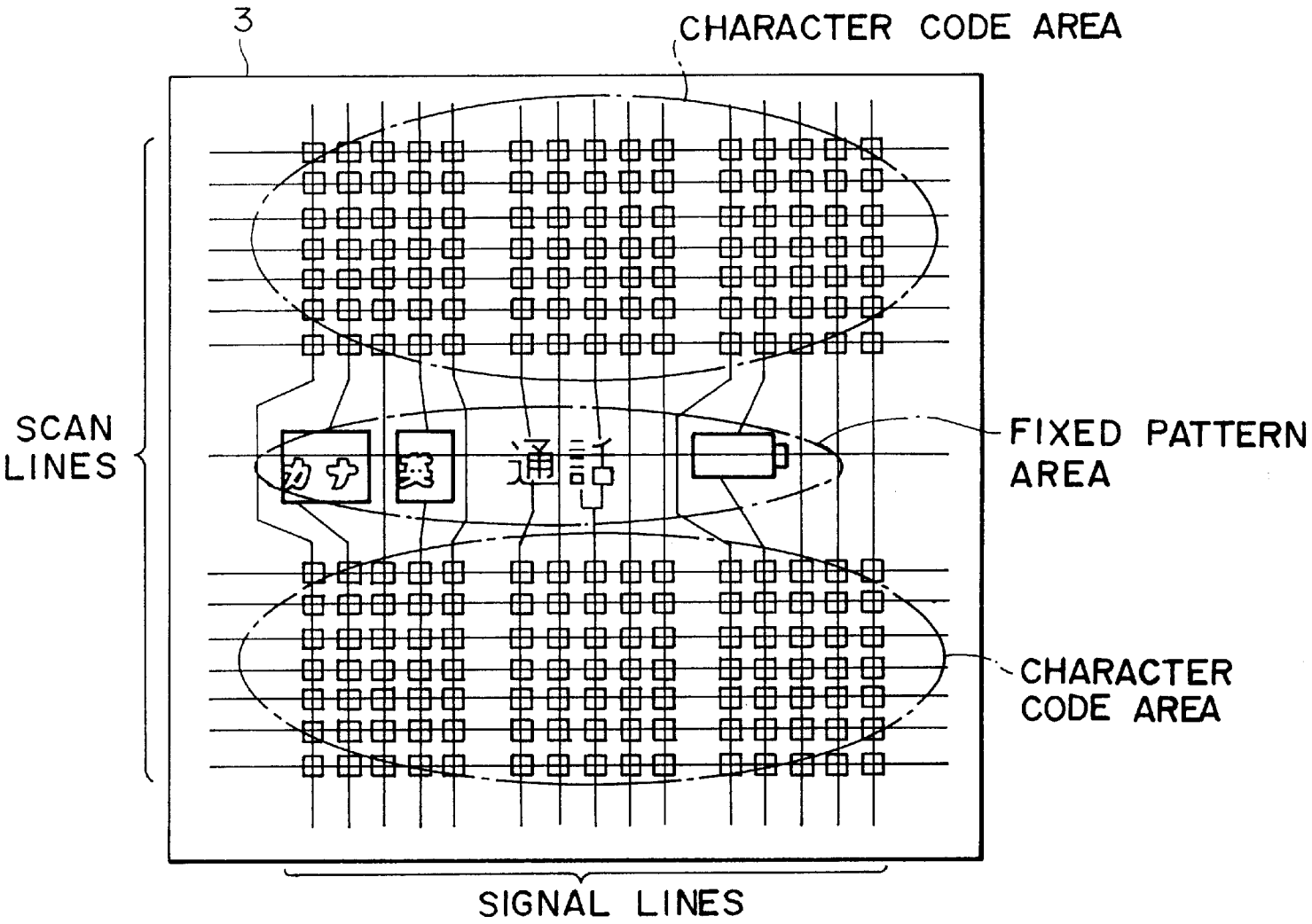
FIG. 29 illustrates a liquid crystal display panel having a character code area and a fixed pattern area.

The liquid crystal display panel 3 may have a character code area and a fixed pattern area, as shown in FIG. 29. The layout of the fixed pattern area depends on the design of the liquid crystal display panel. As shown in FIG. 29, the fixed pattern area may be arranged on the liquid crystal display panel 3 at its middle portion.

When the display memory is mapped in such a liquid crystal display panel 3, it is desirable to map the character code area and the fixed pattern area into different memory areas. This is for such a purpose that the vertical scrolling (i.e., movement of the display position by one dot) may be made only in the character code area to increase the variety of display. In such a case, if the fixed pattern area is located on the liquid crystal display panel 3 for example at its central portion, the address of the display memory 8 will be discontinued, resulting in complication of the display control in the CPU.

According to the present invention, the logical operations possessed by the logical operation means may be used being switched by the external control signal, built-in register and others. Thus, such a liquid crystal display panel as shown in FIG. 29 can be used without complication of the display control in the CPU.

What is claimed is:

1. A drive unit, comprising:

scan line drive means for supplying signals to a plurality of scan lines on a display panel;

address generating means for generating a first address;

logical operation means including a plurality of logic gates, wherein said logical operation means receives a given control signal and converts using only the logical gates the first address into a second address for a second display mode and then to output the second address when said control signal directs said logical operation means to change a mode of display from a first display mode to the second display mode, wherein said logical operation means includes:

first logical operation means having a plurality of logic gates, wherein said first logical operation means receives said control signal to convert the first address into the second address for the second display mode and then to output the second address to said code data storage means when said control signal directs said first logical operation means to change the mode of display from the first display mode to the second display mode; and second logical operation means having a plurality of logic gates, wherein said second logical operation means receives said control signal to convert the first address into the second address for the second display mode and then to output the second address to said pattern data storage means when said control signal directs said second logical operation means to change the mode of display from the first display mode to the second display mode;

display data storage means for storing display data and for reading and outputting stored display data based on an output from said logical operation means, wherein said display data storage means includes code data storage means for storing code data, and pattern data storage means for storing pattern data specified by said code data; and signal line drive means for supplying signals to a plurality of signal lines on said display panel based on the display data from said display data storage means.

2. The drive unit according to claim 1, wherein said control signal is generated based on one of a signal from an external terminal and contents of a built-in register, wherein said signal and contents can be changed to be adjusted to a mounting form of said display panel.

3. An electronic equipment comprising the drive unit according to claim 1.

4. A drive unit, comprising:

scan line drive means for supplying signals to a plurality of scan lines on a display panel;

address generating means for generating a first address, wherein said address generating means performs the same operation that is performed for the write address by said display data storage means for the first address;

logical operation means including a plurality of logic gates, wherein said logical operation means receives a given control signal and converts using only the logical gates the first address into a second address for a second display mode and then to output the second address when said control signal directs said logical operation means to change a mode of display from a first display mode to the second display mode, wherein said logical operation means performs another operation reverse to the operation performed for the write address by said display data storage means for the second address when said control signal directs said logical operation means to change the mode of display from the first mode to the second mode;

display data storage means for storing display data and for reading and outputting stored display data based on an output from said logical operation means, wherein said display data storage means automatically performs one of an increment operation and a decrement operation for a write address at each time when an external control means writes the display data after setting of an initial address, wherein said display storage means further includes code data storage means for storing code data, and pattern data storage means for storing pattern data specified by said code data; and wherein said logical operation means further includes:

first logical operation means having a plurality of logic gates, wherein said first logical operation means receives said control signal to convert the first address into the second address for the second display mode and then to output the second address to said code data storage means when said control signal directs said first logical operation means to change the mode of display from the first display mode to the second display mode; and second logical operation means having a plurality of logic gates, wherein said second logical operation means receives said control signal to convert the first address into the second address for the second display mode and then to output the second address to said pattern data storage means when said control signal directs said second logical operation means to change the mode of display from the first display mode to the second display mode;

signal line drive means for supplying signals to a plurality of signal lines on said display panel based on the display data from said display data storage means.

5. The drive unit according to claim 4, wherein said control signal is generated based on one of a signal from an external terminal and contents of a built-in register, wherein said signal and contents can be changed to be adjusted to a mounting form of said display panel.

6. An electronic equipment comprising the drive unit according to claim 4.

7. A drive unit comprising:

scan line drive means for supplying signals to a plurality of scan lines on a display panel;

address generating means for generating a first address;

code data storage means for storing code data;

pattern data storage means for storing first pattern data specified by said code data;

first logical operation means having a plurality of first logic gates, wherein said first logical operation means receives a given control signal and converts using only the first logic gates the first address into a fourth address for a fourth display mode and then to output the fourth address to said code data storage means when said control signal directs said first logical operation means to change a mode of display from a first display mode to the fourth display mode;

second logical operation means having a plurality of second logic gates, wherein said second logical operation means receives said control signal and converts using only the second logic gates the first address into the fourth address for the fourth display mode and then to output the fourth address to said pattern data storage means when said control signal directs said second logical operation means to change the mode of display from the first display mode to the fourth display mode;

third logical operation means having a plurality of third logic gates, wherein said third logical operation means receives said control signal and converts using only the third logic gates the first pattern data into a fourth pattern data for the fourth display mode and then to output the fourth pattern data when said control signal directs said third logical operation means to change the mode of display from the first display mode to the fourth display mode;

a plurality of decoder means for receiving said control signal to generate fourth fetching signals for the fourth display mode based on the first address when said control signal directs said decoder means to change the mode of display from the first display mode to the fourth display mode;

a plurality of temporary storage means each of which is provided for each of said decoder means for temporarily storing the fourth pattern data based on one of the fourth fetching signals; and signal line drive means for supplying signals to a plurality of signal lines on said display panel based on an output from said temporary storage means.

8. The drive unit according to claim 7, wherein said code data storage means automatically performs one of an increment operation and a decrement operation for a write address at each time when an external control means writes said code data after setting of an initial address;

wherein said address generating means performs the same operation that is performed for the write address by said code data storage means for the first address; and wherein said second logical operation means performs another operation reverse to the operation performed for the write address by said code data storage means for the fourth address when said control signal directs said second logical operation means to change the mode of display from the first mode to the fourth mode.

9. The drive unit according to claim 8, wherein said control signal is generated based on one of a signal from an external terminal and contents of a built-in register, wherein said signal and contents can be changed to be adjusted to a mounting form of said display panel.

10. An electronic equipment comprising the drive unit according to claim 8.

11. The drive unit according to claim 7, wherein said control signal is generated based on one of a signal from an external terminal and contents of a built-in register, wherein said signal and contents can be changed to be adjusted to a mounting form of said display panel.

12. An electronic equipment comprising the drive unit according to claim 7.

* * * * *